US007400842B2

(12) United States Patent
Takehara et al.

(10) Patent No.: US 7,400,842 B2
(45) Date of Patent: Jul. 15, 2008

(54) HEAT EXHAUSTION APPARATUS AND IMAGE FORMING APPARATUS USING SAME

(75) Inventors: Kenichi Takehara, Tokyo (JP); Yasuaki Iijima, Kanagawa (JP); Junya Takigawa, Tokyo (JP); Tomoaki Suga, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 270 days.

(21) Appl. No.: 11/271,808

(22) Filed: Nov. 14, 2005

(65) Prior Publication Data

US 2006/0120748 A1 Jun. 8, 2006

(30) Foreign Application Priority Data

Nov. 15, 2004 (JP) ..... 2004-331143
Nov. 15, 2004 (JP) ..... 2004-331144
Nov. 15, 2004 (JP) ..... 2004-331270

(51) Int. Cl.
*G03G 21/20* (2006.01)

(52) U.S. Cl. ..... 399/92; 399/94

(58) Field of Classification Search ..... 399/92, 399/94, 179, 124, 111
See application file for complete search history.

(56) References Cited

U.S. PATENT DOCUMENTS 5,146,279 A 9/1992 Seyfried
6,275,670 B1 * 8/2001 Cho et al. ..... 399/92
6,308,024 B1 * 10/2001 Nakayama et al. ..... 399/92
2004/0052545 A1 * 3/2004 Satoh ..... 399/92
2004/0101328 A1 * 5/2004 Kimura et al. ..... 399/111

FOREIGN PATENT DOCUMENTS

| | | |
|---|---|---|
| EP | 1 271 259 A1 | 1/2003 |
| JP | 59-192159 | 12/1984 |
| JP | 8-160839 | 6/1996 |
| JP | 8-171317 | 7/1996 |
| JP | 10-149067 | 6/1998 |
| JP | 3121220 | 12/2000 |
| JP | 2003-208065 | 7/2003 |
| JP | 2004-205999 | 7/2004 |

* cited by examiner

*Primary Examiner*—Susan S Lee
(74) *Attorney, Agent, or Firm*—Oblon, Spivak, McClelland, Maier & Neustadt, P.C.

(57) ABSTRACT

Heat exhaust holes are provided in a unit frame at positions just above respective imaging units. An exhaust fan causes air heated at developing elements to be exhausted outside an apparatus via heat exhaust ducts and a common duct. The heat exhaust holes are formed in different sizes depending on a position of the imaging unit. The closer the position of the imaging unit is, the larger the heat exhaust hole provided above the imaging unit is.

20 Claims, 16 Drawing Sheets

HEAT EXHAUSTION APPARATUS AND IMAGE FORMING APPARATUS USING SAME

CROSS-REFERENCE TO RELATED APPLICATIONS

This application is based upon and claims the benefit of priority from Japanese Patent Application Nos. 2004-331143, 2004-331144, and 2004-331270, filed Nov. 15, 2004, the entire contents of which are incorporated herein by reference.

BACKGROUND OF THE INVENTION

1. Field of the Invention

The present invention relates to a technology for exhausting heat from a developing device in an image forming apparatus.

2. Description of the Related Art

Recently, in an image forming apparatus utilizing an electrophotographic system, apparatuses that can form a color image, such as a color copying machine and a color printer, are increasing to meet a demand from the market. As the color image forming apparatus, there are a one drum type and a tandem type. In the one drum type, plural developing elements are arranged around one image carrier (photosensitive element). In the tandem type, plural imaging units are arranged in parallel.

The one drum type has an advantage in that size and cost can be easily reduced due to the one image carrier constitution. However, it is difficult to achieve speed-up in forming an image because a full color image must be formed through plural (generally four) image formations using only one image carrier. On the other hand, the tandem type tends to be increased in size and cost because of plural imaging units arranged therein. However, speed-up can be facilitated. Since a color image is recently demanded to be formed in a speed as fast as a monochrome image is formed, the tandem type apparatus gains more attention.

As a tandem type image forming apparatus, a color image forming apparatus of a tandem type including an intermediate transfer belt supported by plural supporting rollers and plural photosensitive elements arranged in parallel to be opposed to the intermediate transfer belt is disclosed in Japanese Utility Model Application Laid-Open (JP-U) No. S59-192159 and Japanese Patent Application Laid-Open (JP-A) No. H8-160839. In the image forming apparatus, a color image can be formed on a transfer member by primarily transferring respective visible images formed on the respective photosensitive elements on the intermediate transfer belt in superimposition and secondarily transferring the visible images on the intermediate transfer belt collectively on the transfer member.

FIG. 21 is a schematic of a tandem type image forming apparatus. As shown in FIG. 21, the image forming apparatus includes a paper feed table 200, a main unit 100 above the paper feed table 200, and a scanner 300 above the main unit 100. The main unit 100 includes process cartridges 18Y, 18M, 18C, and 18K, each being unitized in a cartridge including a photosensitive element 40, and at least one of devices used for image forming process, such as a photosensitive element 40, a charger, a cleaning device, and a discharger. An optical writing device 103 that forms latent images on the photosensitive elements is disposed above the process cartridges.

A device that performs main scanning of respective light beams emitted from four light sources (not shown) corresponding to the respective photosensitive elements 40Y, 40M, 40C, and 40K using a polygon mirror 211 that is a rotary polygonal mirror serving as a deflecting unit, is used as the optical writing device 103. In the optical writing device 103, light beams emitted from the respective light sources are deflected by the polygon mirror rotationally driven by a polygon motor, and are irradiated on optical writing positions on the photosensitive elements, while being repeatedly reflected by predetermined reflecting mirrors. With this configuration, cost can be suppressed compared to a case in which one deflecting unit is provided for each of the photosensitive elements 40Y, 40M, 40C, and 40K.

Toner particles serving as developer in a developing device are stirred by a stirring screw or the like to be frictionally charged. At this time, toner particles generate heat due to frictional heat among toner particles or between toner particles and the stirring screw. This phenomenon is called "self-heating" of the developer. Heat is also generated by friction between the photosensitive elements 40Y, 40M, 40C, and 40K and a cleaning blade, or by friction between the photosensitive elements 40Y, 40M, 40C, and 40K and toner particles during development is generated. The process cartridges 18Y, 18M, 18C, and 18K are formed compact so that they can be easily taken out from the image forming apparatus. Therefore, the photosensitive element, the developer, the charger, the cleaning devices are densely arranged in each cartridge.

The image forming unit in each of the process cartridges 18Y, 18M, 18C, and 18K is accommodated in a casing. Therefore, the frictional heat tends to accumulate in the process cartridges 18Y, 18M, 18C, and 18K, and temperature inside the process cartridges 18Y, 18M, 18C, and 18K can become high. When the temperature inside the process cartridges 18Y, 18M, 18C, and 18K becomes high, the toner cannot be sufficiently charged. In sufficient charge of the toner causes toner particle scattering or concentration unevenness. Under a high temperature environment, a resistance value of rubber decreases, and, for example, when a charging roller or a developing roller has a rubber layer, a charging bias or a developing bias fluctuates, which may deteriorate formation of an excellent image. In recent years, a demand for making a apparatus compact, parts inside the apparatus are arranged more densely. As a result, parts in the tandem type color image forming apparatus, therefore, heat exhaustion from the inside of the apparatus is a major issue.

Japanese Patent No. 3121220, JP-A No. 2003-208065, and JP-A No. H10-149067 describe image forming apparatuses including plural image forming units, each having a photosensitive element, a developing device, a charger, and a cleaning device, and including an exhaust unit that exhausts to the outside of the apparatus, nitrogen oxide (NOx), ozone, or the like around the respective image forming units generated in an image forming process. In the image forming apparatuses according to Japanese Patent No. 3121220, JP-A No. 2003-208065, and JP-A No. H10-149067, exhaust ducts are arranged to face the photosensitive elements and extend in a scanning direction, so that discharged substances inside the charger are sucked to the exhaust ducts by an exhaust fan. The discharged substances sucked in the exhaust ducts are exhausted to the outside by the exhaust fan. By using the exhaust unit, heated air inside the process cartridges can be sucked and exhausted to the outside so that temperature inside the process cartridges can be suppressed from rising.

JP-A No. 2004-205999 discloses an image forming apparatus in which a developing device itself has a cooling configuration as measures for heat generation in a developing unit. According to JP-A No. 2004-205999, cooling can be performed by utilizing air flow entering through an opening in a developer restricting member.

As described in JP-U. No. S59-192159 or JP-A No. H8-160839, however, in the image forming apparatus in which writings to respective photosensitive elements are performed by utilizing a single optical writing device 103 as shown in FIG. 21, the optical writing device 103 is arranged above the respective process cartridges over them. Therefore, when exhaust ducts are arranged above the process cartridges, they must be arranged between the process cartridges and the optical writing device. Accordingly, to secure a space for providing the exhaust ducts, it is necessary to move the position of the optical writing device to an upper side. Thus, when the optical writing device is moved upwardly, the image forming apparatus is increased in size in a direction of height. As a result, the apparatus becomes tall and not convenient for all users to use.

A height of the exhaust duct can be reduced, and a position of the optical writing apparatus can be set to be not so high. However, when the height of the exhaust duct is reduced, a sectional area of the exhaust duct is also reduced, which results in reduction of an amount of air sucked to the exhaust duct. As a result, since air heated inside the process cartridge cannot be exhausted efficiently, temperature inside the process cartridge cannot be reduced sufficiently. Although a rotation speed of the exhaust fan can be increased to solve this problem, this increase power consumption.

The heat exhaust duct can be arranged on a side face of the process cartridge to exhaust heated air inside the process cartridge from the side face. However, since heated air rises, the heat exhaust duct disposed on the side face is inferior in suction efficiency compared to the heat exhaust duct disposed above a heat source, which is the process cartridge. Therefore, it is difficult to sufficiently lower the temperature inside the process cartridge.

In Japanese Patent No. 3121220, JP-A No. 2003-208065, and JP-A No. H10-149067, a duct for heat exhaustion is arranged in a space above or around the image forming unit. However, if the optical writing device is arranged just above the imaging unit, a space above the imaging unit is partially closed by a frame plate on which the optical writing device is mounted, so that a space above the imaging unit is limited. In a compact color image forming apparatus adopting the tandem system, since respective imaging units are arranged to be close to one another, spaces cannot be secured around respective sides of the imaging units. When a duct for heat exhaustion is disposed in the limited small space, workability becomes poor for a general method such as a screwing work, and powder dust due to screwing (metal or resin debris) is generated or a distal end of a projecting screw abuts on an attachable and detachable imaging unit.

In JP-A No. 2004-205999, since interior of the apparatus is densely arranged and routes for heat exhaustion are reduced, it is difficult to effectively cool the imaging unit (developing device). Particularly on a back side of the apparatus, effective cooling cannot be performed because heat is more likely to accumulate on the back side.

SUMMARY OF THE INVENTION

It is an object of the present invention to at least solve the problems in the conventional technology.

An image forming apparatus according to one aspect of the present invention includes a plurality of imaging units, each of which includes an image carrier and a developing device, the imaging units detachably arranged in a main unit of the image forming apparatus; an optical writing device configured to scan respective light beams emitted from a light source toward respective image carriers, and to perform optical writing on the image carriers; a heat exhaust duct provided for each of the imaging units and arranged between the optical writing device and each of the imaging units; and an exhaust fan arranged on a side opposite to a side from which the imaging units are attached or detached to and from the main unit, and configured to cause air heated at the imaging units to be exhausted outside the main unit via the heat exhaust ducts.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Figure 1:
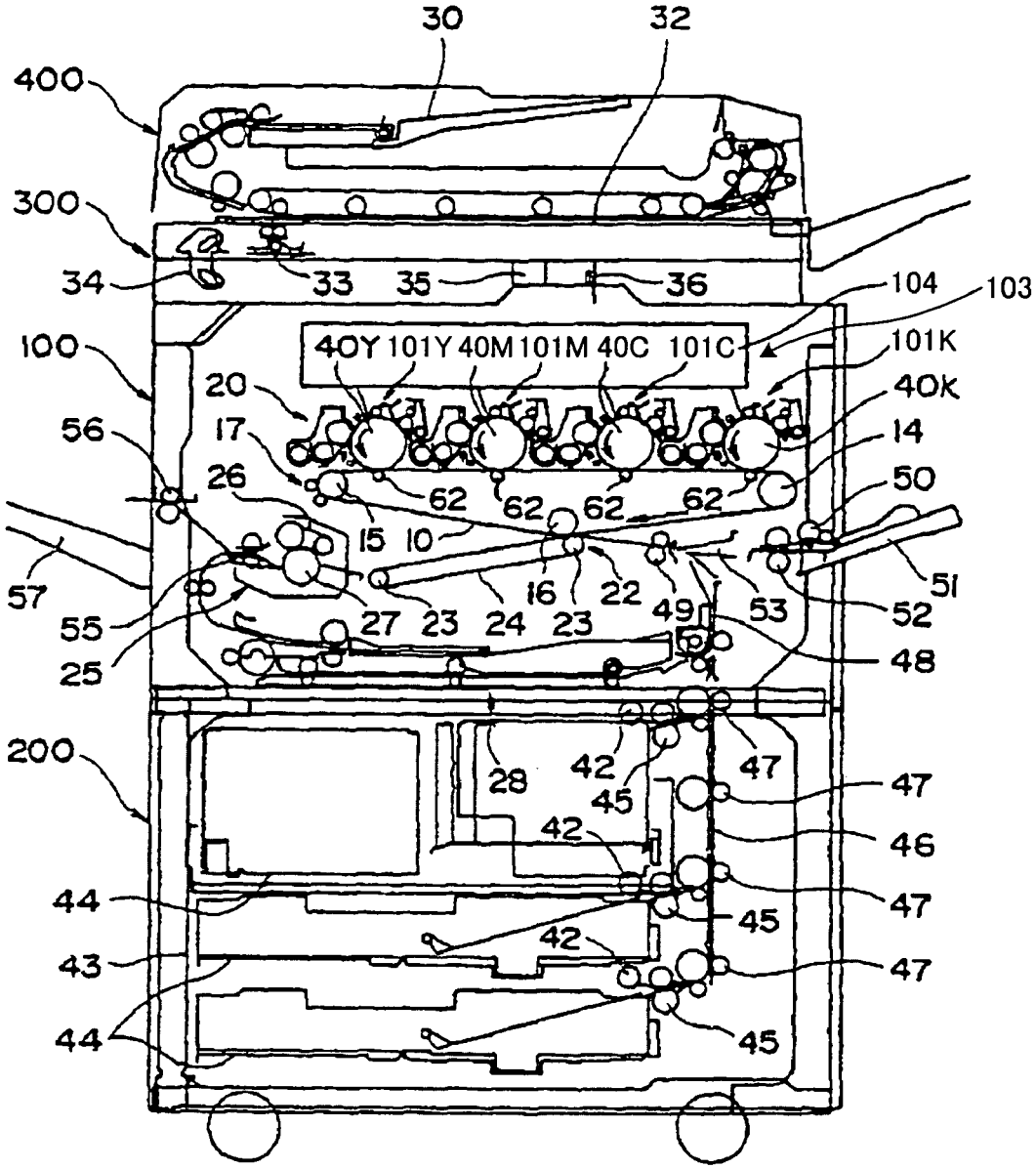
FIG. 1 is a schematic of a copying machine according to a first embodiment of the present invention.

Exemplary embodiments according to the present invention will be explained in detail with reference to the accompanying drawings. FIG. 1 is a schematic of a copying machine according to a first embodiment of the present invention. As shown in FIG. 1, the copying machine includes the main unit 100 and a paper feeding unit (a paper feed table) 200 on which the main unit is placed. Reference numeral 300 denotes a scanner mounted on the main unit 100, and reference numeral 400 denotes an automatic document feeder (ADF) provided above the scanner 300. The copying machine is an electrophotographic copying machine of a tandem type adopting an intermediate transfer (indirect transfer) system.

The main unit 100 includes an intermediate transfer belt 10 that is an intermediate transfer member serving as an image carrier at a central portion thereof. The intermediate transfer belt 10 is spanned around three supporting rollers 14, 15, and 16 serving as supporting and rotating members, and it is rotationally moved in a clockwise direction in FIG. 1. An intermediate-transfer-belt cleaning device 17 that removes residual toner on the intermediate transfer belt 10 after an image is transferred is provided on a left side of the second supporting roller 15 of the three supporting rollers in FIG. 1. An imaging section 20 of a tandem type in which imaging units 101Y, 101M, 101C, and 101K serving as four process cartridges for yellow (Y), magenta (M), cyan (C), and black (K) are arranged along a belt moving direction is disposed so as to be opposed to a portion of the belt spanned between the first supporting roller 14 and the second supporting roller 15 of the three supporting rollers. In the embodiment, the second supporting roller 15 serves as a driving roller. The optical writing device 103 serving as a latent image forming unit is provided above the imaging section 20 of the tandem type. Respective constituent parts in the optical writing device 103 are received and housed in a housing case 104 to prevent adverse influence due to dusts or the like.

A secondary transfer device 22 serving as a second transfer unit is provided on the opposite side of the intermediate transfer belt 10 from the imaging section 20 of the tandem type. In the secondary transfer device 22, a secondary transfer belt 24 serving as a recording member conveying member is spanned between two rollers 23. The secondary transfer belt 24 is disposed to be pressed on the third supporting roller 16 via the intermediate transfer belt 10. An image on the intermediate transfer belt 10 is transferred on a sheet that is a recording member by the secondary transfer device 22. A fixing device 25 that fixes an image transferred on the sheet is provided on the left side of the secondary transfer device 22 shown in FIG. 1. The fixing device 25 has a configuration in which a pressurizing roller 27 is pressed on a fixing belt 26. The secondary transfer device 22 also includes a sheet conveying function of conveying a sheet with a transferred image to the fixing device 25. A transfer roller or a non-contacting type charger can be disposed as the secondary transfer device 22, in which case, it is difficult to provide the transfer roller or the non-contacting type charger with the sheet conveying function. In the embodiment, a sheet reversing device 28 for reversing a sheet to record images on both sides thereof is also provided under the secondary transfer device 22 and the fixing device 25 to be parallel to the imaging section 20 of the tandem type.

When a copy is made using the copying machine, a document is set on a platen 30 of the ADF 400. Alternatively, the ADF 400 is opened and a document is set on a contact glass 32 of the scanner 300, and the document is pressed by closing the ADF 400. When a start button (not shown) is pressed, the document set in the ADF 400 is moved onto the contact glass 32. On the other hand, when the document is set on the contact glass 32, the scanner 300 is driven. Subsequently, a first running member 33 and a second running member 34 are run. Light from a light source is emitted by the first running member 33, reflected light from a surface of the document is directed to the second running member 34, and it is reflected by a mirror in the second running member 34 to be input into a reading sensor 36 via an imaging lens 35, so that content of the document is read.

In parallel with the reading of the document, the driving roller 16 is rotationally driven by a driving motor (not shown) that is a driving source. Thus, the intermediate transfer belt 10 is moved in a clockwise direction in FIG. 1, and the remaining two supporting rollers (driven rollers) 14 and 15 are rotated following the movement of the intermediate transfer belt 10. Simultaneously therewith, photosensitive element 40Y, 40M, 40C, and 40K serving as latent image carriers are rotated in the individual imaging units 101Y, 101M, 101C, and 101K, and exposure and development are conducted to the respective photosensitive element using individual color information of yellow, magenta, cyan, and black, so that single color toner images (visible images) are formed on the photosensitive element. The toner images on the respective photosensitive elements 40Y, 40M, 40C, and 40K are sequentially transferred on the intermediate transfer belt 10 so as to be superimposed with one another, so that a composite color image is formed on the intermediate transfer belt 10.

When a color printer is used as the image forming apparatus, a laser diode (LD) is driven in the optical writing device 103 based on image data transmitted from a host computer such as a personal computer (PC) to irradiate laser beam to a polygon mirror, reflected light from the polygon mirror is guided to the photosensitive element 40Y, 40M, 40C, and 40K via a cylinder lens or the like, and exposure and development are conducted on the respective photosensitive element using individual color information of yellow, magenta, cyan, and black, so that single color toner images (visible images) are formed on the photosensitive element. The toner images on the respective photosensitive element 40Y, 40M, 40C, and 40K are sequentially transferred on the intermediate transfer belt 10 so as to be superimposed with one another, so that a composite color image is formed on the intermediate transfer belt 10.

In parallel with such image formation in the copying machine or the color printer, one of paper feed rollers 42 in the paper feeding unit (paper feed table) 200 is selected and rotated. Sheets are fed from one of multi-tier paper feed cassettes 44 provided in a paper bank 43, separated to individual sheets by a separating roller 45 to be directed to a paper feed path 46, then directed to a paper feed path 48 in the main unit 100 by being conveyed by a conveyance roller 47, and the sheet is stopped at a registration roller 49 by contact thereto. Alternatively, sheets on a manual feed tray 51 are fed by rotating a paper feed roller 50 and separated to individual sheets by a separating roller 52 to be directed to a manual paper-feed path 53, and the sheet is stopped at the registration roller 49. The registration roller 49 is rotated in timing with the composite image on the intermediate transfer belt 10 to feed the sheet between the intermediate transfer belt 10 and the secondary transfer device 22, so that the color image is transferred on the sheet by the secondary transfer device 22. The sheet transferred with the image is conveyed by the secondary transfer belt 24 to be fed to the fixing device 25. After the transferred image is fixed on the sheet by heat and pressure in the fixing device 25, switching to a sheet discharge route is performed by a switching claw 55 so that the sheet is discharged by a discharge roller 56 to be stacked on a paper discharge tray 57. Alternatively, switching to another route is performed by the switching claw 55 so that the sheet is fed to the sheet reversing device 28 where the sheet is reversed. The reversed sheet is guided to the transfer position again, and after an image is recorded on a back side of the sheet, the sheet is discharged on the paper discharge tray 57 by the discharge roller 56.

Residual toner on the intermediate transfer belt 10 after the image is transferred is removed by the intermediate-transfer-belt cleaning device 17 so that the intermediate transfer belt 10 is prepared for the next image formation performed by the imaging section 20 of the tandem type. The registration roller 49 is often grounded; however, it can be applied with a bias for removing paper dust on the sheet.

Using the copying machine, a black and white (monochrome) copy can be made. Alternatively, monochrome printing can be performed even with the color printer, in which case, the intermediate transfer belt 10 is separated from the photosensitive element 40Y, 40M, and 40C by a unit (not shown). Driving of the photosensitive element 40Y, 40M, and 40C is stopped temporarily. Only the photosensitive drum 40K for black is brought in contact with the intermediate transfer belt 10, so that image formation and transferring are conducted.

Figure 2:
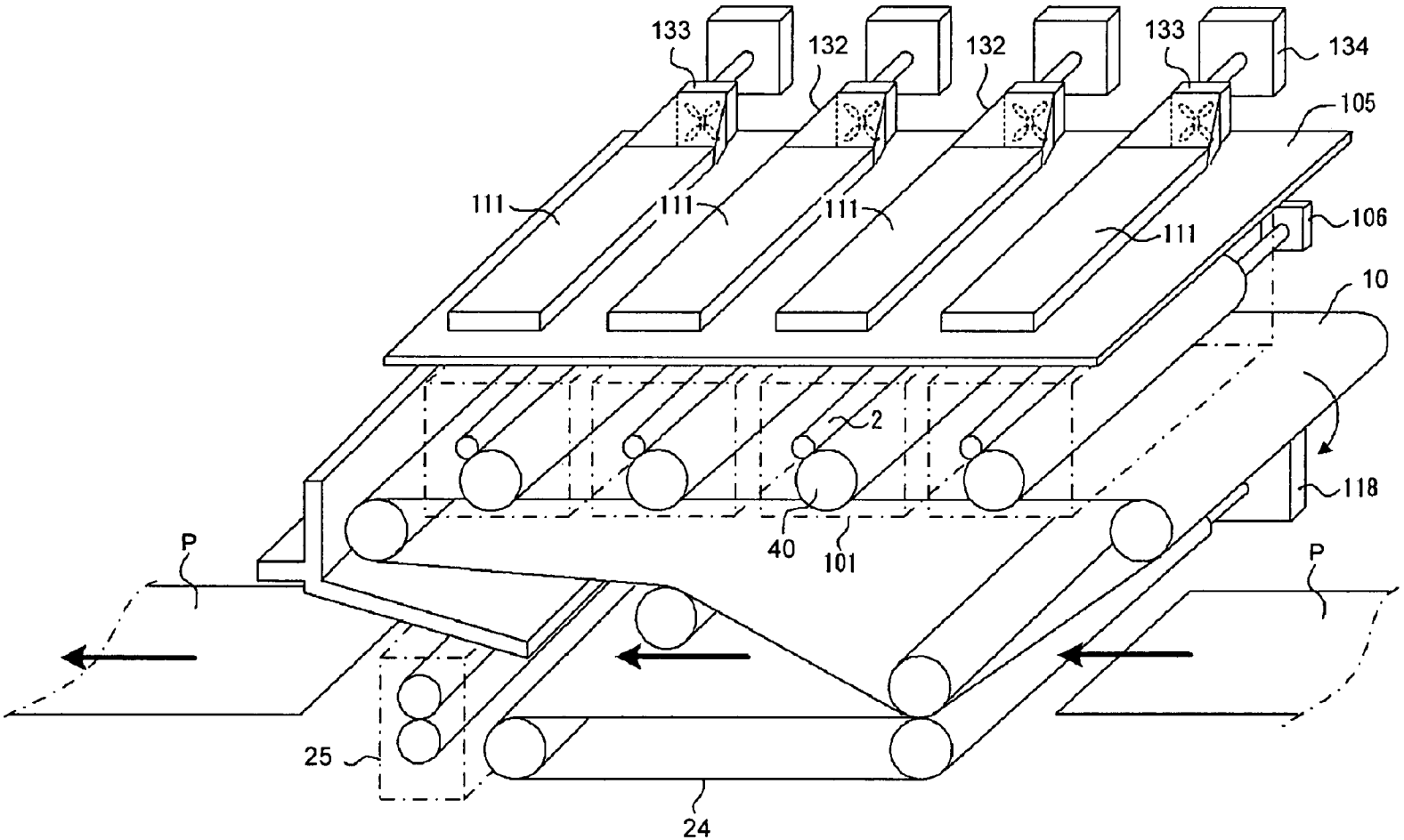
FIG. 2 is a partial perspective view of a cooling mechanism for imaging units in an image forming apparatus according to the first embodiment.

FIG. 2 is a perspective view of a cooling mechanism for the imaging units 101Y, 101M, 101C, and 101K in the image forming apparatus. Hereinafter, when a configuration common to the respective imaging units 101Y, 101M, 101C, and 101K is explained, they are collectively represented as an imaging unit 101, and when a configuration common to the photosensitive element 40Y, 40M, 40C, and 40K is explained, they are collectively represented as a photosensitive drum 40.

Figure 3:
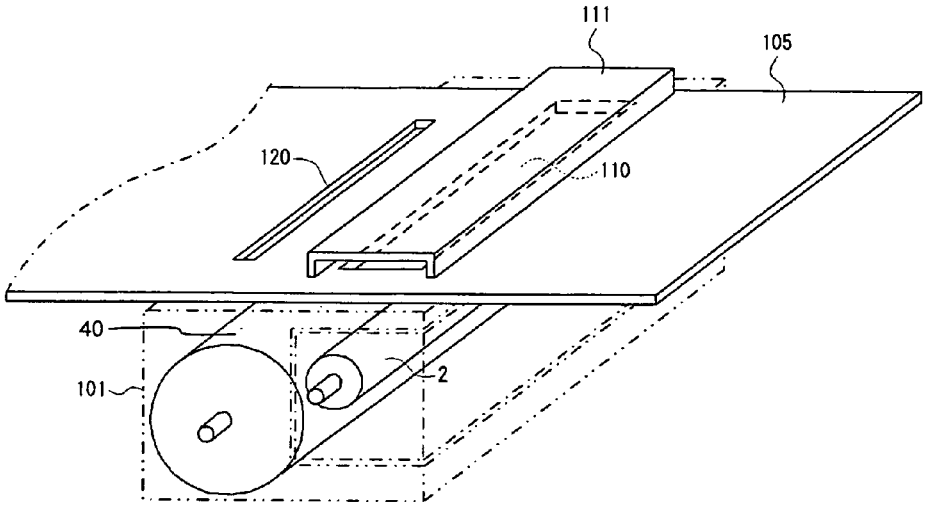
FIG. 3 is a partial perspective view of an imaging section.

FIG. 3 is a partial perspective view of the imaging section 20, as viewed from a back side thereof. The imaging unit 101 includes a photosensitive drum 40 serving as an image carrier, a developing element, and other devices required for an electrophotographic process, and it is configured to be attachable to and detachable from a front face side of the apparatus main unit as a process cartridge. In FIG. 3, a developing roller 2 is shown as the developing element.

A unit frame 105 on which the optical writing device 103 is mounted is provided above the imaging unit 101, as shown in FIGS. 2 and 3. That is, the respective imaging units 101 are arranged in parallel just below the unit frame 105. To downsize the apparatus, a clearance is hardly provided between the imaging units 101 and the unit frame 105. In other words, only a slight gap is provided between the imaging unit 101 and the unit frame 105 to an extent that they do not contact with each other. A clearance between the units adjacent to each other in a widthwise direction of the apparatus is set to only several millimeters, so that heat generated in the imaging units (developing units) tends to accumulates in the apparatus, particularly, in the back side thereof. Since a clearance between adjacent imaging units is set to only several millimeters, it is impossible to arrange the exhaust ducts as those in the conventional image forming apparatus above the imaging units 101 (between the imaging unit 101 and the unit frame 105) or between the adjacent imaging units.

In the embodiment, therefore, heat exhaust holes 110 for releasing the hot air are provided at portions of the unit frame 105 corresponding to the developing elements in the respective imaging units 101, as shown in FIG. 3. The imaging unit 101 is schematically shown in a box shape, however, it is not necessary for the imaging unit 101 to have photosensitive drum, the developing element, and the like accommodated in a case. For example, the imaging unit 101 can have respective devices required for the electrophotographic process arranged around the photosensitive element (devices are exposed). As shown in FIG. 2, the respective devices can be accommodated in a process case (of any shape). If the imaging unit is accommodated in a case, the heat exhaust hole can be provided at a portion of the case corresponding to an upper portion of the developing element.

Each heat exhaust hole 110 extends in a direction of a shaft of the developing element (a shaft of the developing roller 2) in each imaging unit, and it is provided to extend in front and rear directions of the apparatus in parallel with a hole (writing hole) 120 bored in the unit frame 105 for leading writing light to the photosensitive element from the optical writing device 103.

Heat exhaust ducts 111 are mounted on an upper face of the unit frame 105 for covering the heat exhaust holes 110. Each heat exhaust duct 111 has a box-shaped lid configuration whose bottom face and side face at a back side of the apparatus are opened and whose remaining four sides are closed. Hot air from the imaging unit 101 rising through the heat exhaust hole 110 is exhausted by an exhaust fan 133 provided at a back side of the apparatus. The heat exhaust ducts 111 and the exhaust fans 133 are connected to each other by communication ducts 132. The exhaust fans 133 are rotationally driven by motors 134. In the embodiment, the respective exhaust fans 133 are individually driven by the motors 134, however, the respective exhaust fans 133 can be driven by a single motor.

As shown in FIG. 2, each exhaust fan 133 is disposed at an opposite side from a side of the apparatus through which the imaging unit 101 is attached and detached, namely, not at an opening side of the heat exhaust duct 111 for attaching and detaching the imaging unit 101 but at a closed side thereof where heat tends to accumulate corresponding to the opposite side (the back side of the apparatus) from the opening side. Therefore, more heat can be exhausted at the side where heat tends to accumulate, so that the developing element can be cooled further efficiently. In the embodiment, heat generated at the imaging unit 101 mainly comes from self-heating at the developing unit (heat generated by friction occurring among toner particles in the developing element).

In the example shown in FIGS. 2 and 3, the secondary transfer device is configured as the transfer and conveyance belt 24, however, a transfer unit having any configuration, such as a transfer rolls, can be adopted. In this case, it is necessary to connect the secondary transfer unit and the fixing device 25 using a separate conveyance belt. FIG. 2 depicts a transfer paper P as a recording medium being conveyed from the secondary transfer unit to the fixing device and discharged after being fixed. Reference numeral 106 in FIG. 2 denotes a motor that drives the photosensitive drum 40. Reference numeral 118 denotes a motor for driving the driving roller for the transfer and conveyance belt 24.

Figure 4:
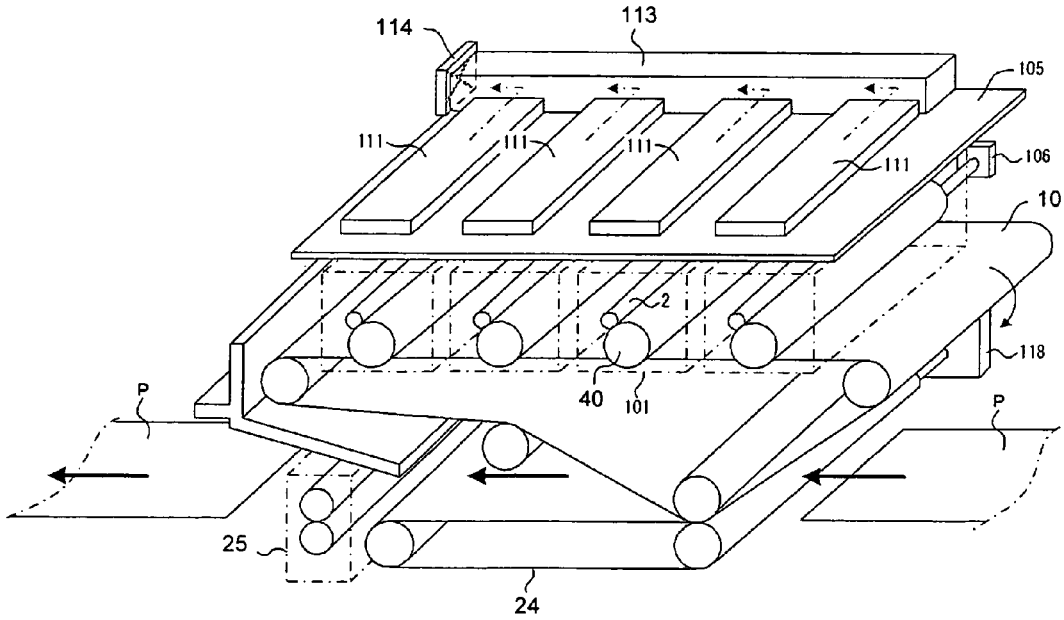
FIG. 4 is a perspective view of an imaging section adopting a first modification of the cooling mechanism.

FIG. 4 is a perspective view of the imaging section 20 adopting a first modification of the cooling mechanism. A difference of the cooling mechanism in the first modification from that shown in FIG. 2 is that the respective heat exhaust ducts 111 are connected to a common duct (a collecting duct) 113 to join together at the back side of the apparatus and hot air is exhausted by a single exhaust fan 114. Other configurations of the cooling mechanism in the first modification are similar to those shown in FIG. 2.

In the first modification, since the common duct 113 is provided at a back side of the apparatus where heat tends to accumulate and air is exhausted at the back side of the apparatus, more heat can be exhausted at the side where heat tends to accumulate, so that the developing element can be cooled efficiently. Since ventilation resistance in the modification is increased as compared with the cooling mechanism shown in FIG. 2, it is desirable that a sirocco fan with high static pressure is used as the exhaust fan 114. In the modification, since hot air is exhausted by a single common exhaust fan 114, cooling for the developing unit can be performed efficiently in spite of low cost.

Figure 5:
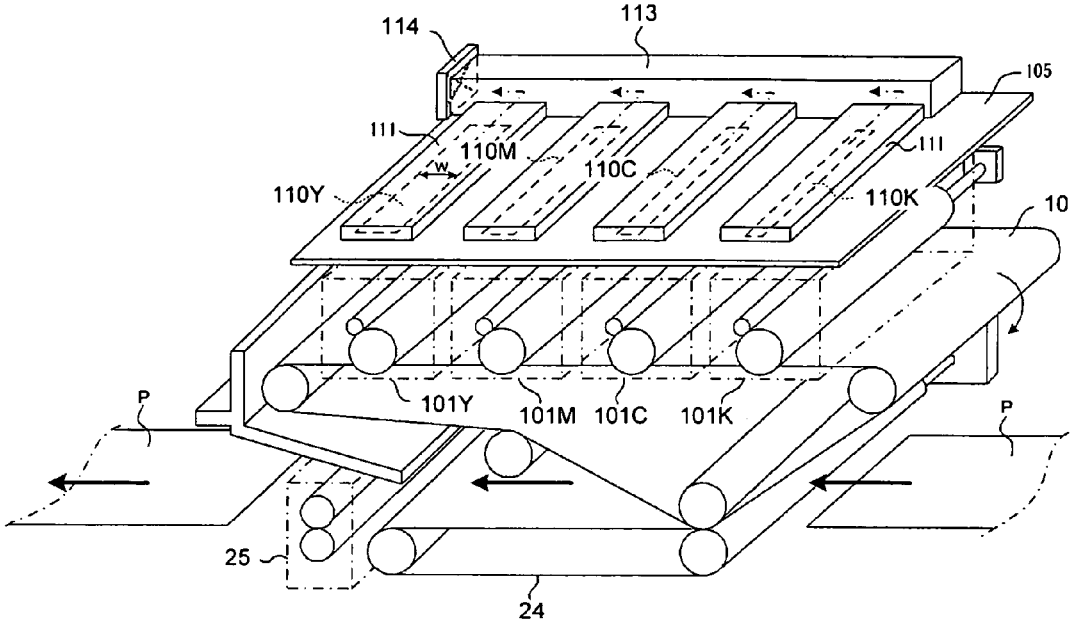
FIG. 5 is a perspective view of an imaging section adopting a second modification of the cooling mechanism.

FIG. 5 is a perspective view of the imaging section 20 adopting a second modification of the cooling mechanism. A difference of the cooling mechanism of this modification from that of the first modification shown in FIG. 4 is that the heat exhaust holes 111Y, 110M, 110C, and 110K of the imaging unit nearer to the fixing device 25 are made larger than those of the imaging units farther therefrom. Other configurations of the cooling mechanism in the second modification are similar to those in the first modification.

In the second modification, areas of the heat exhaust holes 110Y, 110M, 110C, and 110K provided corresponding to the imaging units 101Y, 101M, 101C, and 101K are different from one another and they are set to satisfy the relationship of 110Y>110M>110C>110K. That is, the respective imaging units are influenced not only by self-heating of the developing elements in the imaging units but also by heat of the fixing device 25. Particularly, since the imaging unit nearer to the fixing device 25 is more greatly influenced by the fixing device 25, the area of the heat exhaust hole 110 of the imaging unit nearer to the fixing device 25 is made larger (the width w of the heat exhaust hole is made larger). Thus, more heat can be exhausted from the imaging unit nearer to the fixing device, so that efficient cooling can be conducted considering the influence from the fixing device 25. Sizes of the heat exhaust ducts 111 corresponding to the respective imaging units 101Y, 101M, 101C, and 101K are the same.

The area setting for the heat exhaust holes 110Y, 110M, 110C, and 110K in the above explanation is only one example, and it can be modified appropriately. For example, the areas of the heat exhaust holes 110C and 110K corresponding to the two imaging units 101C and 101K far from the fixing device 25 can be set to be the same, and the areas of the heat exhaust holes 110Y and 110M corresponding to the two imaging units 101Y and 101M near to the fixing device 25 are made larger than those of the heat exhaust holes 110C and 110K (110Y=110M>110C=110K).

Figure 6:
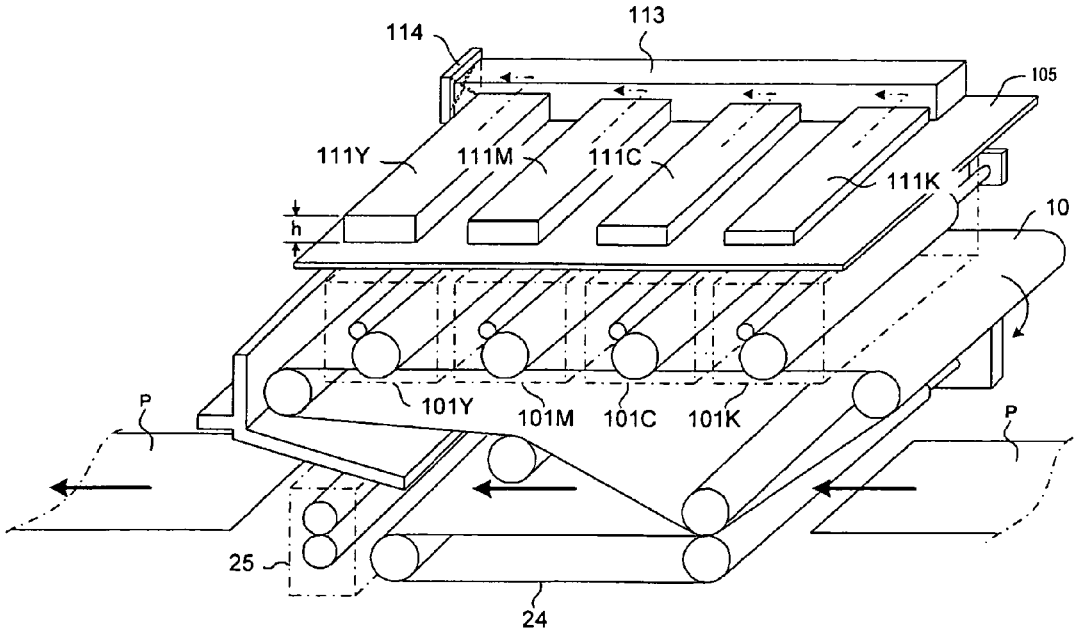
FIG. 6 is a perspective view of an imaging section adopting a third modification of the cooling mechanism.

FIG. 6 is a perspective view of an imaging section 20 adopting a third modification of the cooling mechanism. A difference of the cooling mechanism of the third modification from that of the first modification shown in FIG. 4 is that the heat exhaust duct 111 corresponding to the imaging unit 101 nearer to the fixing device 25 is made larger than that corresponding to the imaging unit 101 farther from the fixing device 25. Other configurations in the third modification are similar to those in the first modification.

In the third modification, sizes of the heat exhaust ducts 111Y, 111M, 111C, and 111K covering the heat exhaust holes 110 provided to correspond to the imaging units 101Y, 101M, 101C, and 101K are different from one another, where they are set to satisfy a relationship of 111Y>111M>111C>111K. That is, since the respective imaging units 101 are influenced by self-heating of the developing elements in the units and the imaging unit 101 nearer to the fixing device 25 is more greatly influenced by heat of the fixing device 25, the heat exhaust duct 111 of the imaging unit 101 nearer to the fixing device 25 is made larger (higher height h) so that it is made larger in sectional area. Thus, more heat can be exhausted from the imaging unit 101 nearer to the fixing device 25, so that efficient cooling can be performed considering influence from the fixing device 25. The sizes of the heat exhaust holes 110 can be the same for the respective imaging units 101. Similarly to the second modification, the size of the heat exhaust hole 110 of the imaging unit nearer to the fixing device 25 can be made larger than that of the heat exhaust hole 110 of the imaging unit 101 farther from the fixing device 25.

The size setting for the respective heat exhaust ducts 111Y, 111M, 111C, and 111K in the above explanation is only one example, and it can be modified appropriately. For example, the sectional areas of the heat exhaust ducts 111C and 111K corresponding to the two imaging units 101C and 101K far from the fixing device 25 can be set to be the same, and the sectional areas of the heat exhaust ducts 111Y and 111M corresponding to the two imaging units 101Y and 101M near to the fixing device 25 are made larger than those of the heat exhaust ducts 111C and 111K (111Y=111M>111C=111K).

Figure 7:
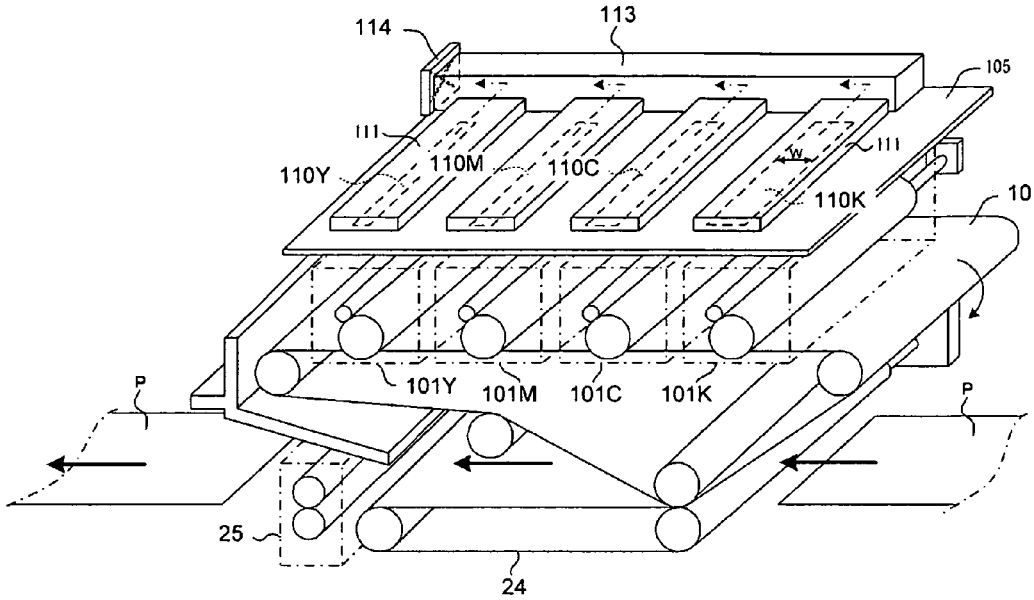
FIG. 7 is a perspective view of an imaging section adopting a fourth modification of the cooling mechanism.

FIG. 7 is a perspective view of the imaging section 20 adopting a fourth modification of the cooling mechanism. A difference of the fourth modification from the first modification shown in FIG. 4 is that the heat exhaust hole 110 corresponding to the imaging unit 101 farther from the exhaust fan is made larger than the heat exhaust hole 110 corresponding to the imaging unit 101 nearer to the exhaust fan 114. Other configurations in the fourth modification are similar to those in the first modification.

In the fourth modification, the areas of the heat exhaust holes 110Y, 110M, 110C, and 110K corresponding to the imaging units 101Y, 101M, 101C, and 101K are different from one another, where they are set to satisfy a relationship of 110Y<110M<110C<110K. That is, since ventilation resistance in a flow path becomes larger according to separation farther from the exhaust fan 114, the heat exhaust hole 110 corresponding to the imaging unit 101 farther from the exhaust fan 114 is made larger in area (in width w). Thus, cooling can be performed evenly to the respective imaging units 101. The sizes of the heat exhaust ducts 111 are set the same for the respective imaging units 101.

The area setting for the respective heat exhaust holes 110Y, 110M, 110C, and 110K is only one example, and it can be modified appropriately. For example, the areas of the heat exhaust holes 110C and 110K corresponding to the two imaging units 101C and 101K far from the exhaust fan 114 can be made the same, and the areas of the heat exhaust holes 110Y and 110M corresponding to the two imaging units 101Y and 101M near to the exhaust fan 114 can be made smaller than those of the heat exhaust holes 110C and 110K (110Y=110M<110C=110K).

Figure 8:
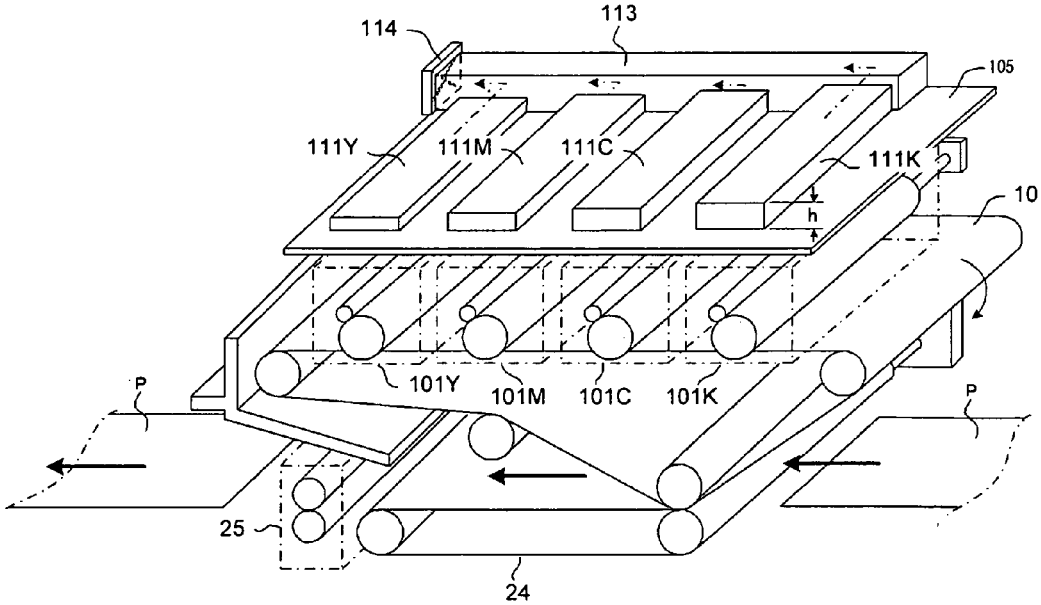
FIG. 8 is a perspective view of an imaging section adopting a fifth modification of the cooling mechanism.

FIG. 8 is a perspective view of the imaging section 20 adopting a fifth modification of the cooling mechanism. A difference of the fifth modification from the first modification shown in FIG. 4 is that the heat exhaust duct 111 corresponding to the imaging unit 101 farther from the exhaust fan 114 is made larger than the heat exhaust duct 111 corresponding to the imaging unit 101 nearer to the exhaust fan 114. Other configurations in the fifth modification are similar to those in the first modification.

In the fifth modification, the sizes of the heat exhaust ducts 111Y, 111M, 111C, and 111K covering the heat exhaust holes 110 provided corresponding to the imaging units 101Y, 101M, 101C, and 101K are different from one another, where they are set to satisfy a relationship of 111Y<111M<111C<111K. That is, since ventilation resistance in a flow path increases according to separation farther from the exhaust fan 114, the size of the heat exhaust duct 111 corresponding to the imaging unit 101 farther from the exhaust fan 114 is made larger (higher height h) to be made larger in sectional area. Thus, cooling can be performed evenly to the respective imaging units. The sizes of the air exhaust holes 110 can be the same for the respective imaging units 101, or the heat exhaust hole 110 corresponding to the imaging unit 101 farther from the exhaust fan 114 can be made larger than that for the imaging unit 101 nearer to the exhaust fan 114, similarly to the fourth modification.

The size setting for the respective heat exhaust ducts 111Y, 111M, 111C, and 111K is only one example, and it can be modified appropriately. For example, the sectional areas of the heat exhaust ducts 111C and 111K corresponding to the two imaging units 101C and 101K far from the exhaust fan 114 can be made the same, and the sectional areas of the heat exhaust ducts 111Y and 111M corresponding to the two imaging units 101Y and 101M near to the exhaust fan 114 can be made smaller than those of the heat exhaust ducts 111C and 111K (111Y=111M<111C=111K).

In the embodiment, since the exhaust fan is disposed at the opposite side from the attachment and detachment side of the imaging units 101 as the process cartridges and hot airs from the imaging units 101 are exhausted outside the copying machine by the exhaust fan via the heat exhaust ducts 111, heat can be effectively exhausted at the side where heat tends to accumulate, so that the imaging units 101, particularly, the developing units can be cooled effectively.

The present invention is not limited to the embodiment and the modifications. In the respective modifications shown in FIGS. 5 and 6, individual exhaust fans can be used for the respective heat exhaust ducts 111, as shown in FIG. 2. The shape and arrangement of the heat exhaust ducts 111 can be set appropriately. The arrangement positions the exhaust fans, the number thereof, and the like can be set arbitrarily. The number of the imaging units 101 is not limited to four, and the configuration of each imaging unit 101 can be set arbitrarily.

Figure 9:
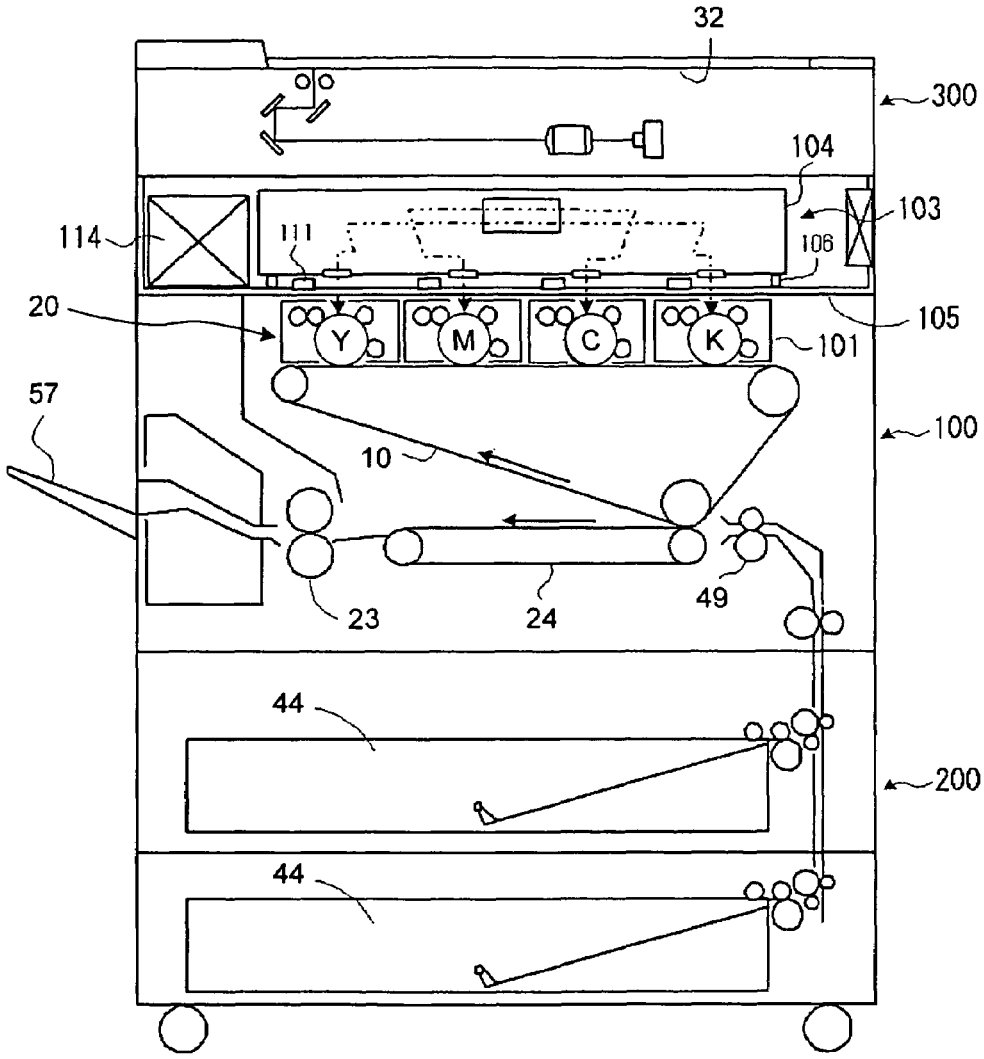
FIG. 9 is a schematic of a copying machine according to a second embodiment of the present invention.

FIG. 9 is a schematic of a copying machine according to a second embodiment of the present invention. A main configuration and an image forming operation of the copying machine according to the second embodiment are similar to those of the copying machine according to the first embodiment.

In the second embodiment, respective constituent parts for the optical writing device 103 arranged just above the respective imaging units 101 are accommodated in the housing case 104. In the copying machine of the second embodiment, the housing case 104 is positioned and supported, via legs 106 on the unit frame 105 on which the optical writing device 103 is mounted. In the coping machine according to the first embodiment and a copying machine according to a third embodiment described later similarly to the second embodiment, the housing case 104 can be positioned and supported on the unit frame 105 via the legs 106.

Figure 10:
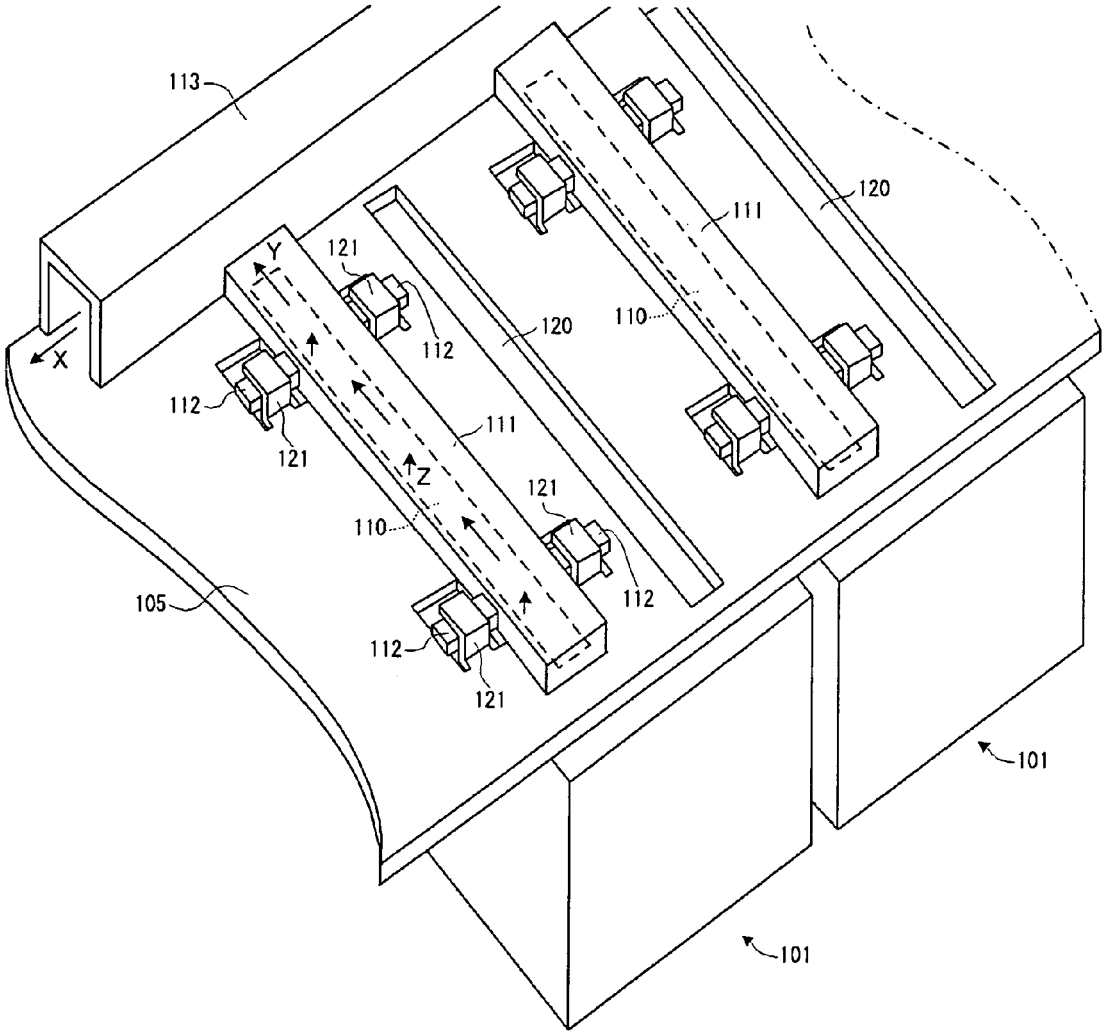
FIG. 10 is a partial perspective view of a cooling mechanism for imaging units in the copying machine shown in FIG. 9.

FIG. 10 is a partial perspective view of a cooling mechanism for the imaging units 101 in the copying machine according to the second embodiment. In FIG. 10, only two of four imaging units 101Y, 101M, 101C, and 101K included in the copying machine of the second embodiment are shown. In FIG. 10, the optical writing device 103 positioned above the imaging units has been omitted to facilitate understanding of the cooling mechanism.

In the copying machine according to the second embodiment, the heat exhaust holes 110 for releasing the hot air are provided in portions of the unit frame 105 corresponding to upper portions of the developing elements in the respective imaging units 101 similarly to the first embodiment. The shape, the arrangement, and the like of the heat exhaust holes 110 are similar to those of the heat exhaust holes 110 of the copying machine of the first embodiment.

In the copying machine of the second embodiment, unlike the first embodiment, two catching portions 121 corresponding to each of both sides of the heat exhaust hole, 101, totaling four (four for one heat exhaust hole 111) catching portions 121, are provided for each heat exhaust hole 101 on the unit frame 105 in a standing manner. In the embodiment, since the unit frame 105 is made from metal, the catching portion 121 is formed of a plate metal obtained by punching a metal plate.

The heat exhaust duct 111 covering the heat exhaust hole 110 is attached on an upper face of the unit frame 105 by fitting projections 112 for attachment provided on both side faces of the duct 111 to the catching portions 121. The catching portion 121 serving as a receiving portion and the projection 112 (fitting member) fitted to the catching portion 121 constitutes a fitting unit. The heat exhaust duct 111 has a box-shaped lid configuration whose bottom face and side face at a back side of the apparatus are opened and whose remaining four sides are closed, where hot air from the imaging unit 101 rising through the heat exhaust hole 110 is led to the common duct 113 (coupling duct) provided at the back side of the apparatus.

Figure 11:
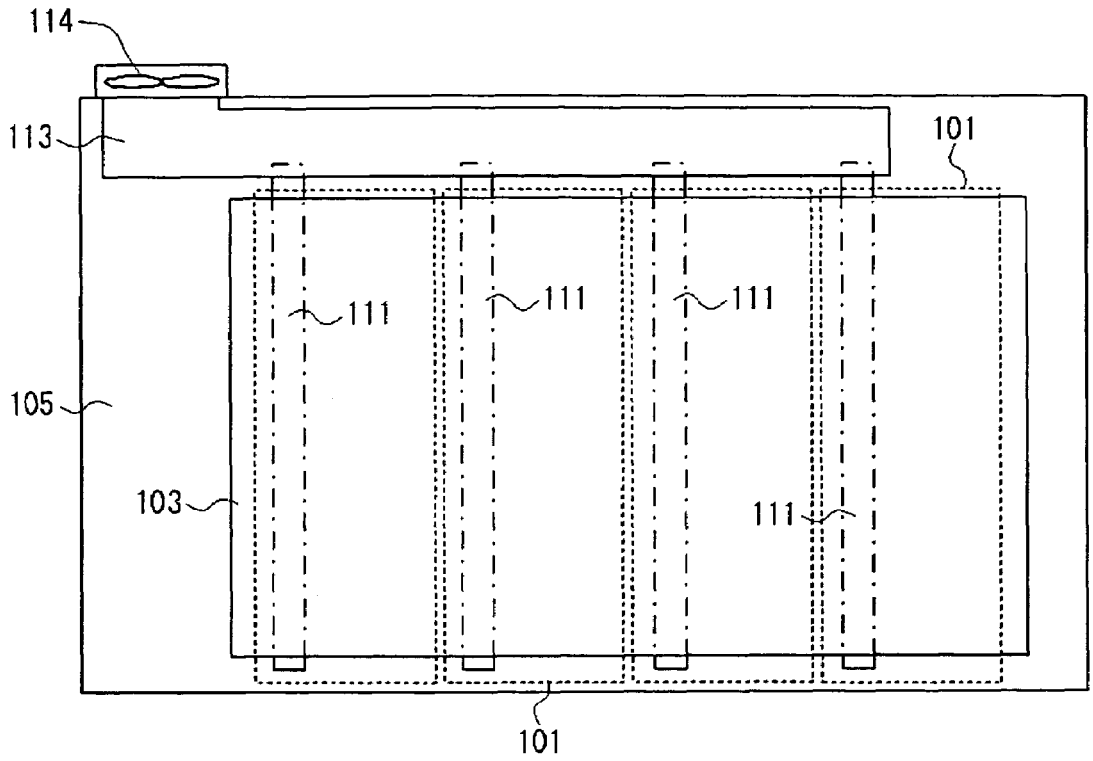
FIG. 11 is a plan view of ducts in the copying machine shown in FIG. 9.

FIG. 11 is a plan view of the ducts in the copying machine according to the second embodiment. As shown in FIG. 11, the common duct 113 is provided to extend in a widthwise direction of the apparatus (left and right directions in FIG. 9 and FIG. 11) and it is connected to the exhaust fan 114 at one end thereof. Thus, when the exhaust fan 114 is rotated, hot air generated in the imaging unit 101 passes through the heat exhaust hole 110 provided in the unit frame 105 (arrow Z in FIG. 10) and passes through the common duct 113 from the heat exhaust duct 111 (arrows Y and X in FIG. 10) to be exhausted outside the copying machine by the exhaust fan 114. In the embodiment, heat generated in the imaging unit 101 mainly comes from self-heating at the developing unit (heat generated by friction occurring among developers in the developing element).

In a compact apparatus adopting a tandem system in which a plurality of (four) imaging units are arranged in parallel and the optical writing device 103 is arranged just above the imaging units 101 like the copying machine according to the embodiment, wherein a space above the imaging units 101 is closed by the unit frame 105 on which the optical writing device 103 is mounted and further a clearance between adjacent imaging units is hardly provided (about 2 millimeters in the embodiment), it is conventionally difficult to exhaust hot air generated in the imaging units. In the second embodiment, however, the heat exhaust holes 110 for allowing passage of hot air from the imaging unit 101 are provided in the unit frame 105 on which the optical writing device 103 is mounted, so that hot air rising through the heat exhaust holes 110 can be exhausted outside the machine by the exhaust fan 114 via the heat exhaust ducts 111 and the common duct 113. Therefore, even if the tandem system in which a plurality of imaging units are arranged in parallel is adopted and the apparatus has no space above the imaging units and on the sides thereof, effective cooling can be performed to the imaging units.

In the embodiment, when the heat exhaust ducts 111 are mounted on the unit frame 105, the mounting can be performed by fitting the projections 112 provided on the sides of each duct to the catching portions 121 of the unit frame 105 without screwing. Since fitting between the projections 112 and the catching portions 121 can be easily performed by sliding the heat exhaust duct 111 on the unit frame 105 from the back side of the apparatus, a mounting work of the duct can be performed considerably easily, and the mounting can be conducted easily even in a small space within the image forming apparatus. Since the heat exhaust duct 111 can be mounted without screwing, there is not a possibility that powder dust that is generated due to screwing operation is not adhered to the photosensitive element.

Figure 12:
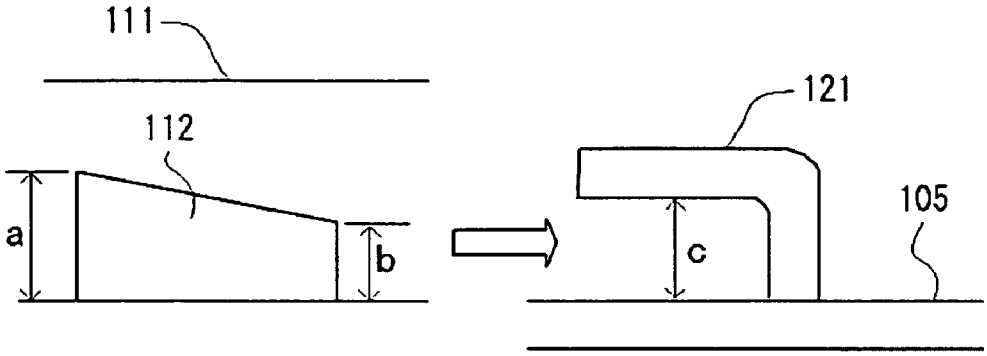
FIG. 12 is a side view of a fitting unit in the copying machine shown in FIG. 9.

A configuration shown in FIG. 12 is preferable for facilitating fitting between the projections 112 of the heat exhaust duct 111 and the catching portions 121 of the unit frame. That is, respective sizes of the catching portion 121 and the projection 112 in side view thereof are set such that, when a height of a distal end of the projection 112 at a fitting time thereof to the catching portion 121 is represented as "b", a height of a rear end thereof is represented as "a", and an inner height of the catching portion 121 is represented as "c", a relationship of a>c>b is satisfied. That is, a height of a clearance of the catching portion 121 is larger than a thickness of the projection 112 at a distal end thereof and a thickness of the projection at a rear end thereof is larger than a height of a clearance of the catching portion 121. Thus, as shown by an arrow in FIG. 12, when the heat exhaust duct 111 is slid on the unit frame 105 from the back side of the apparatus so that the projection 112 is fitted in the catching portion 121, the distal end of the projection 112 is fitted into the catching portion 121 easily. Since the projection 112 is pressed by the catching portion 121 by fitting the projection 112 into the catching portion 121, the heat exhaust duct 111 is pressed on the unit frame 105, so that the heat exhaust duct 111 is fixedly attached on the unit frame 105. Although the projection 112 is tapered herein, a thickness of the projection 112 can be made constant along its length and the catching portion 121 can be tapered. Alternatively, both of the projection 112 and the catching portion 121 can be tapered. The tapered shape facilitates fitting between the portion 112 and the catching portion 121 and they can be attached to each other without any clearance therebetween after being fitted.

Figure 13:
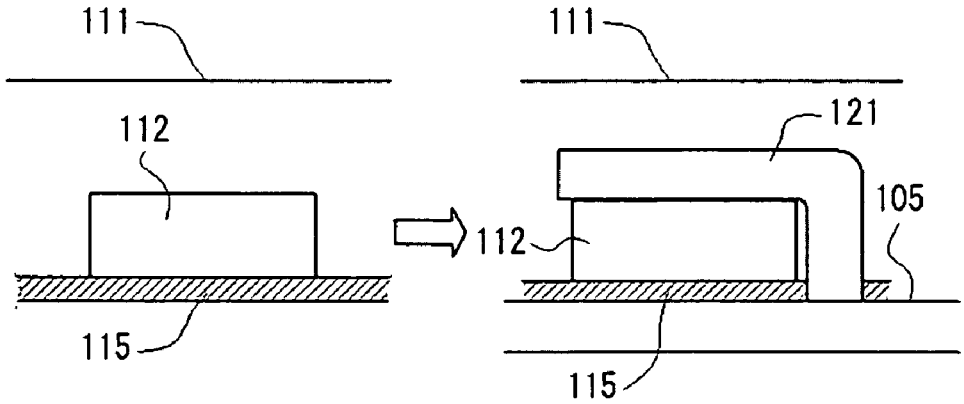
FIG. 13 is a side view of the fitting unit with another configuration in the copying machine shown in FIG. 9.

FIG. 13 is a schematic of the heat exhaust duct 111 attached with an elastic member 115 such as sponge on a bottom face thereof, depicting a state of fitting the heat exhaust duct 111 and the catching portion 121 to each other. In the configurational example shown in FIG. 13, the elastic member 115 is attached on an abutting portion of the heat exhaust duct 111 on the unit frame 105, namely, a bottom face of a wall portion of the duct. As the elastic member 115, a foamed member such as sponge or urethane can be used preferably. When the projection 112 of the heat exhaust duct 111 is fitted in the catching portion 121, the heat exhaust duct 111 is pressed on the unit frame 105, so that the elastic member 115 is compressed. Accordingly, the duct 111 and the frame 105 are closely contacted with each other, so that hot air or toner powder are prevented from leaking, and the heat exhaust duct 111 is fixedly mounted on the unit frame 105 by friction between the elastic member 115 and the frame 105.

Figure 14A:
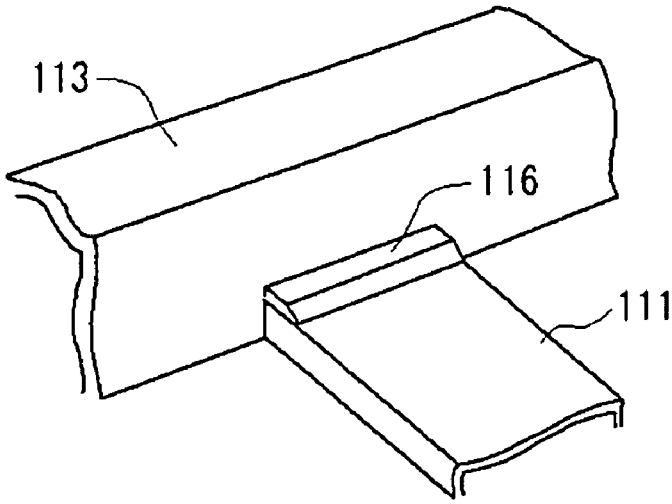
FIGS. 14A and 14B are schematics for illustrating a fitted portion between a heat exhaust duct and a common duct in the copying machine shown in FIG. 9.
Figure 14B:
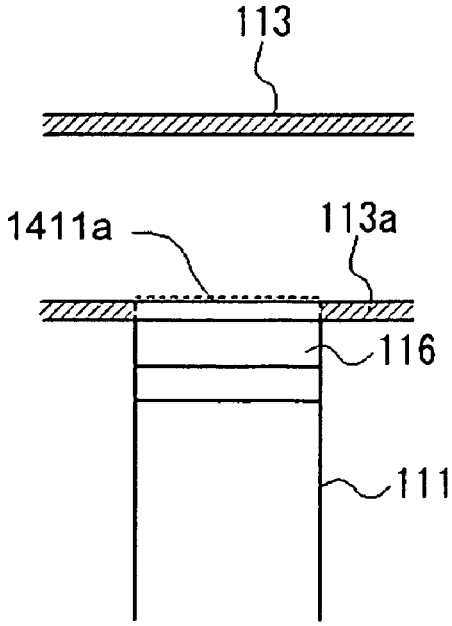

FIGS. 14A and 14B depict a fitted portion between the heat exhaust duct 111 and the common duct 113. FIG. 14A is a perspective view of the fitted portion and FIG. 14B is a plan view thereof. As shown in FIGS. 14A and 14B, a stopper 116 is provided on an upper face of the heat exhaust duct 111 at its end on a back side thereof. The stopper 116 can be formed integrally with the duct, or it can be fixed on the upper face of the duct by adhesion or the like. The stopper 116 is provided at a position on a slightly near side from the back end of the heat exhaust duct 111, and a slight bulge 1411*a* of the duct is provided behind the stopper 116.

A square notch (not shown) in which the bulge 1411*a* of the heat exhaust duct 111 is fitted is provided in the common duct 113, so that the heat exhaust duct 111 on the back side of the apparatus can be positioned by fitting the bulge 1411*a* of the heat exhaust duct 111 into the notch of the common duct 113 and causing a rear end face of the stopper 116 to abut on an outer wall face of the common duct 113. The heat exhaust duct 111 at the near side is positioned by fitting the projection 112 and the catching portion 121 of the unit frame 105 to each other.

In mounting the heat exhaust duct 111 on the unit frame 105, after the projections 112 of the heat exhaust duct 111 are fitted into the catching portions 121 of the unit frame, the common duct 113 is mounted on the unit frame 105, while the budge 1411*a* of the heat exhaust duct 111 is pressed down (screwing is performed in this embodiment, as described later), so that the heat exhaust duct 111 in front and rear directions of the apparatus can be positioned easily and reliably by causing the outer wall face of the common duct 113 to abut on the stopper 116 of the duct. The heat exhaust duct 111 is fixedly mounted on the unit frame 105 by pressing the bulge 1411*a* of the heat exhaust duct 111 from the above at a wall portion 113*a* of the common duct 113.

As is clear with reference to FIG. 11, the common duct 113 is provided nearer to the back of the apparatus than the imaging units 101, and it is arranged so as not to overlap with the imaging unit 101 in plan view. Therefore, even if the common duct 113 is screwed to the unit frame 105, the imaging unit 101 is not influenced.

As described above, in the copying machine according to the embodiment, as shown in FIG. 9, there is hardly a space just above the respective imaging units 101 arranged in parallel. Therefore, when any member is screwed on the unit frame 105, there is a possibility that a distal end of a screw abuts on the imaging unit 101 due to projection thereof from a lower face of the unit frame 105. The imaging unit 101 is detachably mounted as the process cartridge and it is drawn from and inserted in the copying machine in front and back directions in the embodiment. When the distal end of the screw abuts on the imaging unit 101, the unit may be damaged at detaching and attaching times of the imaging unit 101. In the embodiment, however, since the heat exhaust duct 111 can be mounted on the unit frame 105 without using any screw, the imaging unit 101 is not influenced. Since the common duct 113 is positioned so as not to overlap with the imaging unit 101, even if the common duct 113 is screwed to the unit frame 105, the imaging unit 101 is not influenced by the screwing, so that the mounting work is facilitated.

As shown in FIG. 9, the optical writing device 103 is positioned and supported on the unit frame 105 via the legs 106 arranged at four corners of the optical writing device. Since the legs 106 are positioned so as not to overlap with the imaging units 101, even if the optical writing device 103 is screwed on the unit frame 105 at the legs 106, the imaging units 101 are not influenced by the screwing.

In the embodiment, the heat exhaust ducts 111 are arranged (the thickness of the heat exhaust duct 111 is set to about 6 millimeters in the embodiment) by effectively utilizing a clearance of about 10 millimeters formed between the bottom face of the housing case 104 of the optical writing device and the upper face of the unit frame 105 by the legs 106. Thus, even if a space is largely reduced around the imaging units 101 due to size reduction of the apparatus, it is possible to provide the ducts for heat exhaustion to effectively exhaust heat of the imaging unit, particularly, heat generated at the developing units to the outside of the copying machine.

In the copying machine according to the embodiment, the heat exhaust ducts 111 are arranged on the unit frame 105 on which the optical writing device 103 is mounted, between the unit frame 105 and the optical writing device 103, and the heat exhaust ducts 111 are fitted on the unit frame 105 using the fitting units. Therefore, the heat exhaust ducts 111 can be mounted without screwing, so that workability for mounting the heat exhaust ducts 111 can be improved. Further, generation of powder due to screwing and projection of a distal end of a screw below the frame can be prevented.

The present invention is not limited to the second embodiment. For example, although in the embodiment, the projections 112 are provided on the duct and the receiving portions (the catching portions 121) are provided on the unit frame for fitting the heat exhaust duct 111 and the unit frame 105 on which the optical writing device 103 is mounted, receiving portions can be provided on the duct and the projections can be provided on the unit frame. Shapes of the receiving portion and the projection can be determined appropriately.

Figure 15:
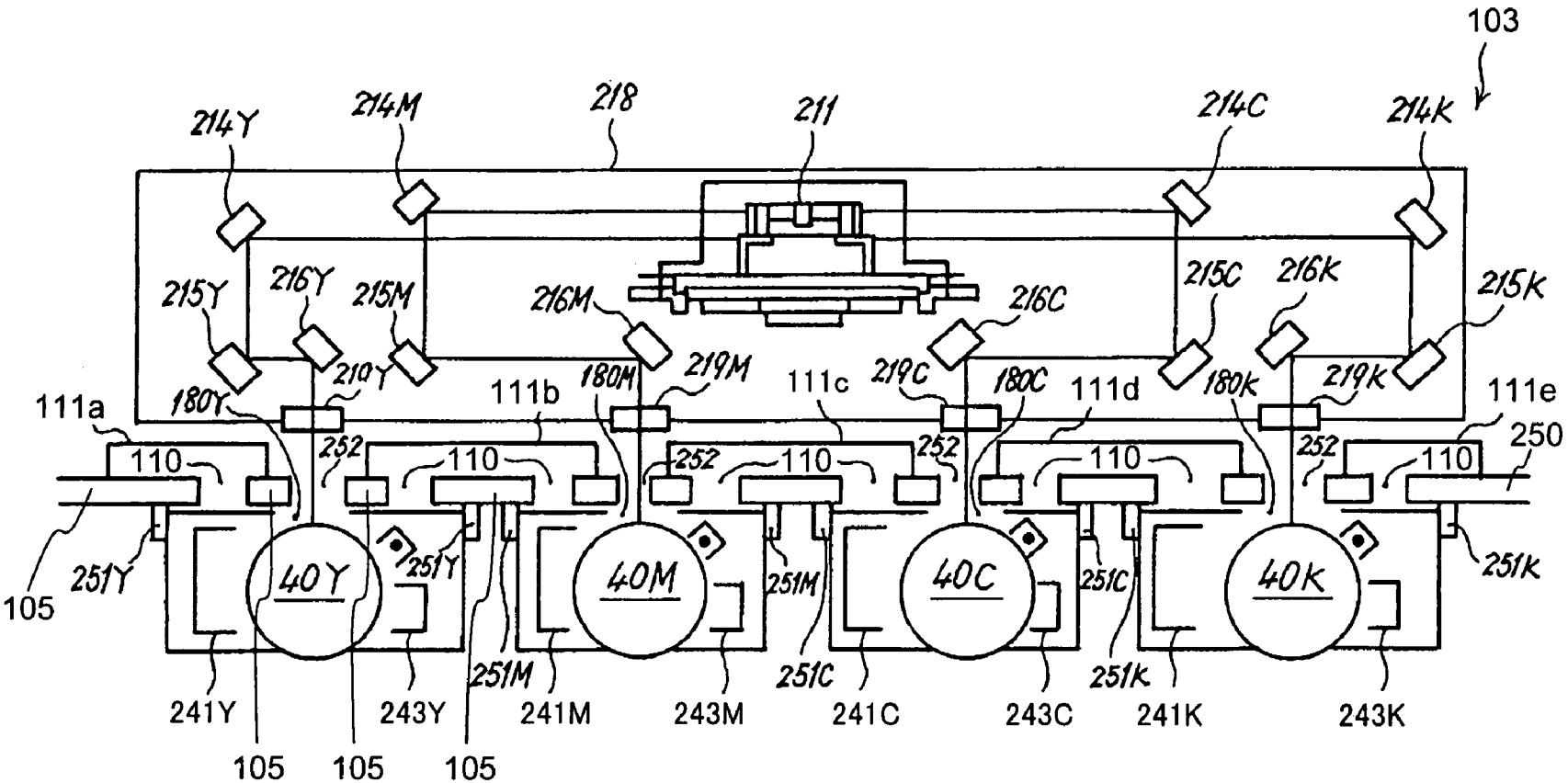
FIG. 15 is a schematic of a copying machine according to a third embodiment of the present invention.

FIG. 15 is a schematic of the copying machine according to the third embodiment of the present invention around the optical writing device 103. The main configuration and the image forming operation of the copying machine of the third embodiment are similar to those of the copying machine of the first embodiment. In the optical writing device 103, respective light beams emitted from four light sources (not shown) corresponding to the photosensitive element 40Y, 40M, 40C, and 40K are main-scanned by the polygon mirror 211 that is a single rotary polygonal mirror serving as a deflecting unit. Light beams emitted from the respective light sources are reflected separately as a scanning light for Y, a scanning light for M, a scanning light for C, and a scanning light for K according to rotation of the polygon mirror 211 rotationally driven by a polygon motor. The scanning light for Y is repeatedly reflected by reflecting mirrors 214Y, 215Y, and 216Y to be irradiated on an optical writing position on the photosensitive element 40Y. The scanning light for M is repeatedly reflected by reflecting mirrors 214M, 215M, and 216M to be irradiated on an optical writing position on the photosensitive element 40M. The scanning light for C is repeatedly reflected by reflecting mirrors 214C, 215C, and 216C to be irradiated on an optical writing position on the photosensitive element 40C. The scanning light for K is repeatedly reflected by reflecting mirrors 214K, 215K, and 216K to be irradiated on an optical writing position on the photosensitive element 40K.

The polygon mirror 211 and the reflecting mirrors 214, 215, and 216 corresponding to respective colors are accommodated in a case 218. Openings corresponding to the respective colors are provided in the case 218 such that light beams deflected by the polygon mirror 211 are irradiated on the optical writing position on the respective photosensitive drum. Dust-proof glasses 219Y, 219M, 219C, and 219K are attached to the openings. Thus, toner particles or paper dusts are prevented from adhering to the polygon mirror 211 and the reflecting mirrors 214, 215, and 216. With this configuration, cost can be suppressed as compared with providing an optical writing device in which deflecting units are individually provided for the respective photosensitive elements.

In the optical writing device 103, base portions (not shown) are provided at four corners thereof, and the base portions are highly accurately attached on the unit frame 105 serving as a base member for the image forming apparatus. Rail members 251 for guiding and supporting the imaging unit 101 serving as the process cartridge is provided on a lower face of the unit frame 105.

As shown in FIG. 15, heat exhaust ducts 111*a*, 111*b*, 111*c*, 111*d*, and 111*e* (hereinafter, "heat exhaust ducts 111) for removing heats of the imaging units 101 are provided on an upper face of the unit frame 105. Exposure openings 252 for allowing passage of light beams from the optical writing device 103 and a plurality of heat exhaust holes 110 that allow heats of the imaging units 101 to be discharged to the heat exhaust ducts 111 are provided in the unit frame 105.

The imaging unit 101 accommodates the photosensitive element 40, the developing device 241, the charger 242, and the cleaning device 243 in its case. An upper face of the case of the imaging unit 101 includes an opening 180 for allowing passage of a light beam. When the imaging unit 101 is mounted on the unit frame 105, the exposure opening 252 of the unit frame 105 and the opening 180 of the imaging unit 101 are superimposed with each other.

A cross section of the heat exhaust duct 111 in a direction normal to the photosensitive element has a laterally long shape in a horizontal direction. A sectional area of the heat exhaust duct 111 in the direction normal to the photosensitive element is 100 square millimeters or more, preferably 150 square millimeters or more. When the sectional area of the heat exhaust duct 111 is 100 square millimeters or less, an amount of air sucked by the heat exhaust duct 111 is reduced, so that heat inside the imaging unit 101 cannot be removed efficiently and a preferable temperature in the imaging unit 101 cannot be achieved.

It is preferable that a height of the heat exhaust duct 111 is 5 millimeters or less. When the height is 5 millimeters of more, the height of the image forming apparatus becomes higher than that of the conventional apparatus, so that space reduction cannot be achieved.

Air heated within the imaging unit 101 is sucked by the heat exhaust ducts 111 provided at two positions. Thus, heat in the imaging unit 101 can be removed efficiently, the sectional area of each heat exhaust duct 111 can be reduced, and space reduction can be achieved.

Figure 16:
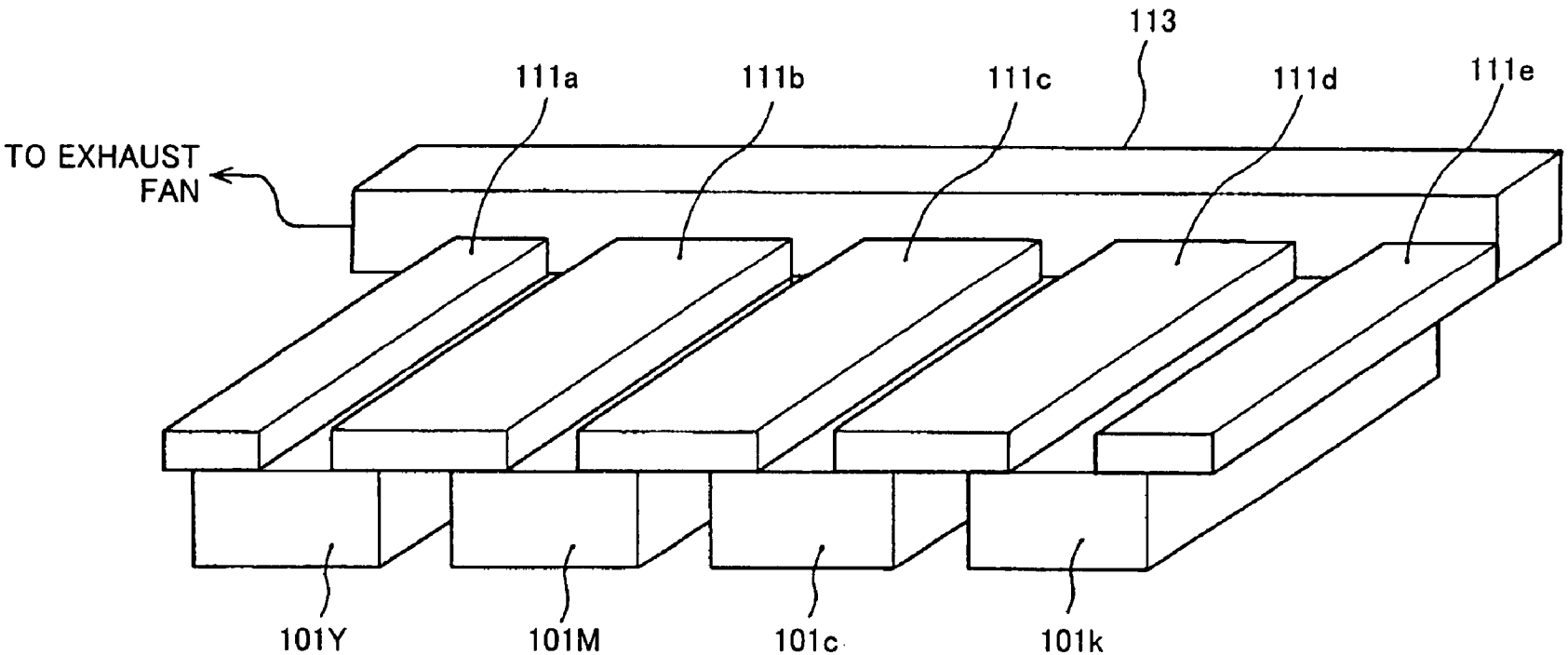
FIG. 16 is a perspective view of a heat exhaust duct and imaging units (process cartridges) in the copying machine shown in FIG. 15.

FIG. 16 is a perspective view of the heat exhaust duct 111 and the imaging unit 101. As shown in FIG. 16, each heat exhaust duct 111 is joined to the common duct 113 at the back side of the apparatus. The common duct 113 is connected to an exhaust fan (not shown). Exhaust fans can be provided for the respective heat exhaust ducts 111 without providing the common duct 113. A filter can be provided to the exhaust fan so that toner particles and paper dusts entering together with hot air are removed and the hot air is exhausted outside the apparatus.

Figure 17:
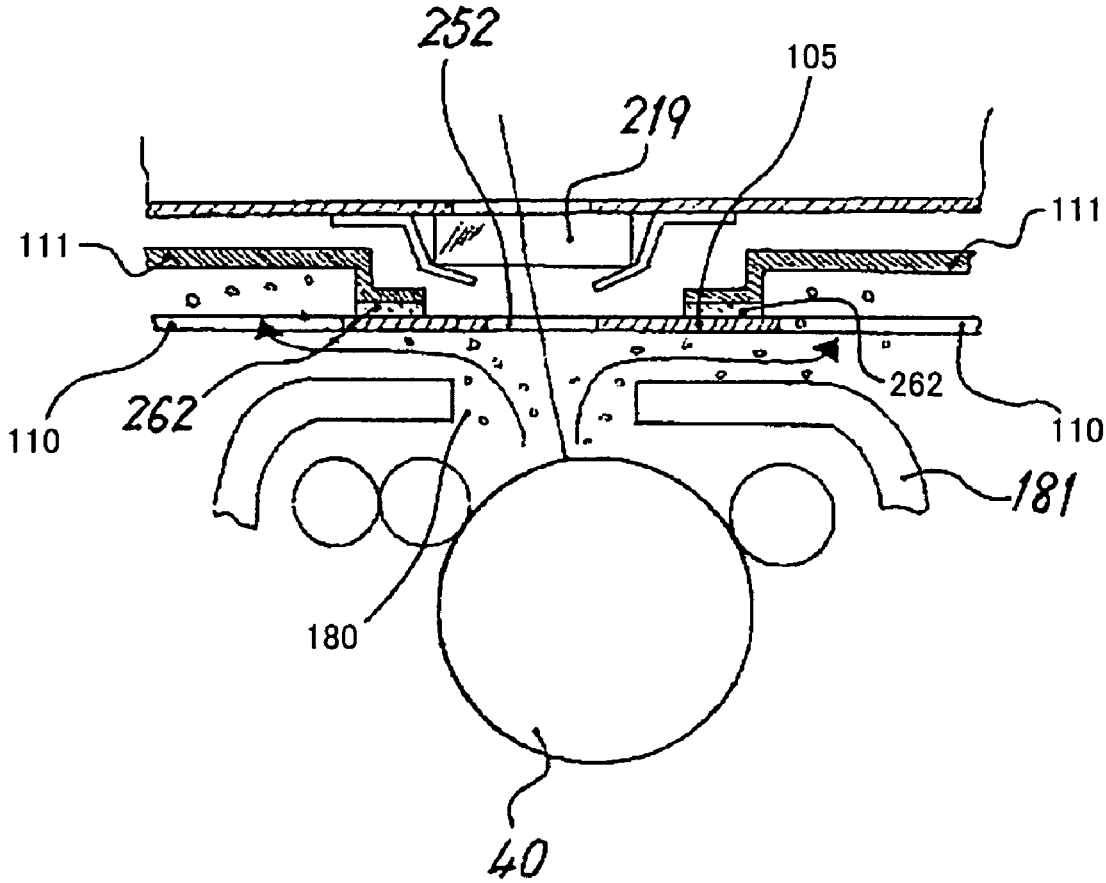
FIG. 17 is an enlarged view of a unit frame (a base member) around an exposure opening in the copying machine shown in FIG. 15.

FIG. 17 is an enlarged view of a portion of the unit frame 105 around the exposure opening 252. As shown in FIG. 17, the heat exhaust duct 111 has a mounting portion on which a foamed plastic 262 is attached, and the heat exhaust dust 111 is mounted on the unit frame 105 via the foamed plastic 262. Since the foamed plastic 262 has flexibility, even if there is slight unevenness on an exhaust duct mounting face of the unit frame 105 or a unit frame mounting face of the heat exhaust duct 111, the unevenness can be absorbed due to deformation of the foamed plastic 262. Therefore, the heat exhaust duct 111 and the unit frame 105 can be mounted on each other without any gap. As a result, it is possible to prevent toner particles and paper dusts sucked together with heat inside the imaging unit 101 from flowing out through a gap between the unit frame 105 and the heat exhaust duct 111, thereby preventing adhesion thereof to a dust-proof glass 219. The foamed plastic is preferable made of a material having an excellent ozone-proof property. While the foamed plastic member is used in the embodiment, the present invention is not limited to plastic. A flexible member such as a rubber member can be used.

As shown in FIG. 17, air heated by frictional heat generated due to friction among toner particles within the imaging unit 101 or the like is sucked from the opening 180 of the case 181 of the imaging unit 101 to the heat exhaust holes 110 provided on both sides of the exposure opening 252 of the unit frame 105 by rising air occurring naturally and an exhaust fan (not shown). At that time, toner particles and paper dusts are also sucked in the heat exhaust hole 110. By providing the heat exhaust holes 110 besides the exposure opening 252 of the unit frame 105, heated air exhausted to the heat exhaust duct 111 together with toner particles is suppressed from passing near the dust-proof glass 219 so that toner particles or the like can be suppressed from adhering to the dust-proof glass 219. Heated air sucked in the heat exhaust holes 110 flows into the common duct 113 shown in FIG. 16 through a route defined by the heat exhaust duct 111 and the unit frame 105 to be exhausted outside the image forming apparatus by an exhaust fan (not shown).

Figure 18:
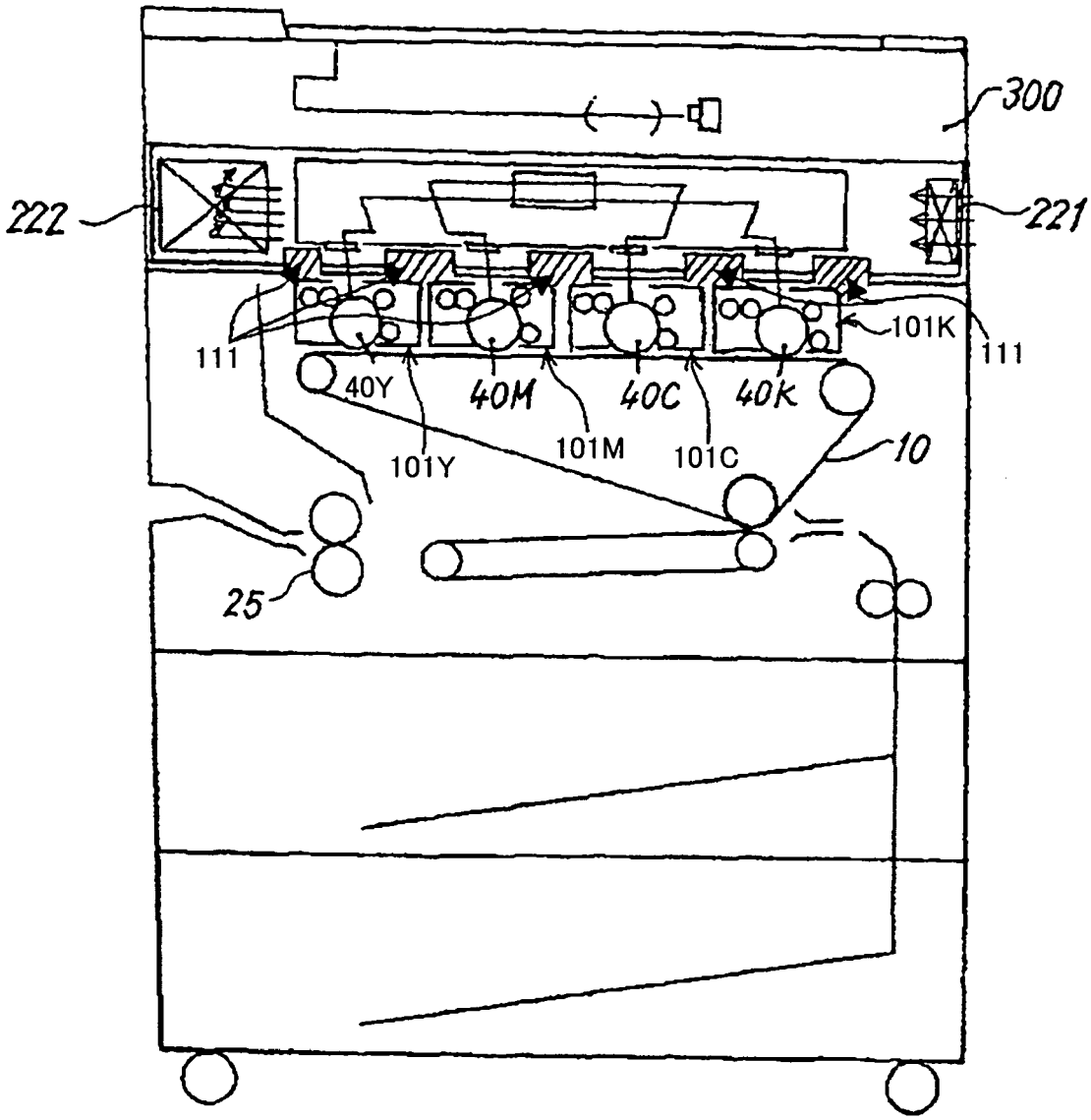
FIG. 18 is a schematic of an image forming apparatus including an air sucking fan and an exhaust fan in the copying machine shown in FIG. 15.

As shown in FIG. 18, when the copying machine includes a suction fan 221 and an exhaust fan 222 for cooling the optical writing device 103, a rotation speed of the suction fan 221 or the exhaust fan 222 or both for cooling the optical writing device 103 is adjusted such that a flow rate of air for cooling the optical writing device 103 becomes equal to or less than a flow rate of air inside the heat exhaust duct. Thus, pressure at the heat exhaust hole 110 of the unit frame 105 can be set negative relative to pressure at the exposure opening 252 of the unit frame 105. As a result, air heated due to self-heating of the imaging unit 101 can be suppressed from flowing in the exposure opening 252 of the unit frame 105, so that toner particles or the like exhausted together with heated air can be suppressed from adhering to the dust-proof glass 219.

Figure 19:
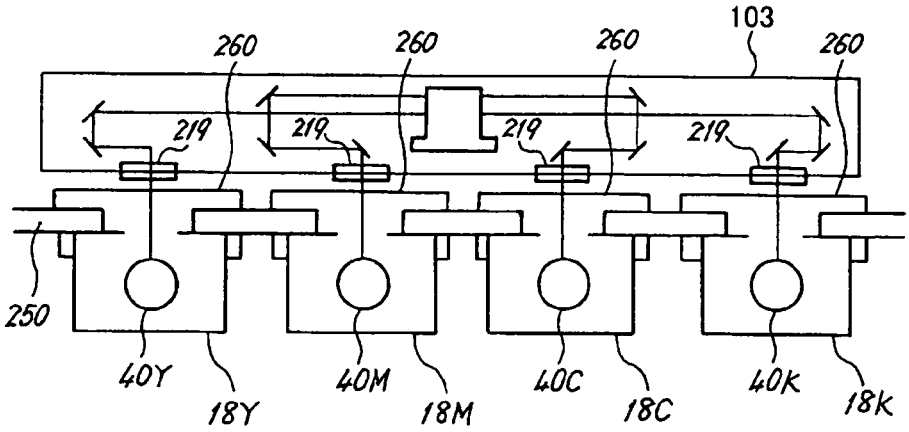
FIG. 19 is a schematic of the heat exhaust duct with another configuration in the copying machine shown in FIG. 15.

The arrangement position of the heat exhaust duct 111 is not limited to the above example, but the heat exhaust duct 111 can be provided on a route for the light beam, as shown in FIG. 19. However, it is necessary to cause the light beam from the optical writing device 103 to pass through the heat exhaust duct 111 to irradiate the light on a writing position on the photosensitive element 40, for example, by adopting a transparent material for the heat exhaust duct 111.

According to the copying machine of the third embodiment, a vertical sectional shape of the heat exhaust duct 111 for exhausting heated air within each imaging unit 101 is set such that a horizontal length thereof is longer than a vertical length thereof. Specifically, the heat exhaust duct 111 has a vertical sectional shape in which a height thereof is 5 millimeters or less and a vertical sectional area thereof is 100 square millimeters or more.

Thus, the heat exhaust duct 111 can be set to have a sectional area (100 square millimeters or more) that allows suction of a sufficient amount of heated air for lowering temperature inside the imaging unit 101 while suppressing the height of the heat exhaust duct 111. As a result, the arrangement position of the optical writing device 103 can be suppressed from being higher than that in the conventional image forming apparatus, and the temperature inside the imaging unit 101 can be lowered sufficiently. The heat exhaust ducts 111 are arranged between the optical writing device 103 arranged above the respective imaging units 101 and the imaging units 101. Therefore, since the heat exhaust ducts 111 are positioned above the respective imaging units 101, heated air inside the imaging unit 101 that has rising property can be sucked to the heat exhaust ducts 111 efficiently.

According to the copying machine of the embodiment, the unit frame 105 separately includes the exposure opening through which each light beam emitted from the optical writing device to each image carrier passes, and the heat exhaust hole 110 for movement of heated air within each imaging unit 101 to the heat exhaust duct 111. When one hole serves both as the exposure opening 252 and the heat exhaust opening 110, there is a possibility that heated air inside the imaging unit 101 flows near the dust-proof lens for the optical writing device 103. Toner particles or paper dusts may adhere to the dust-proof lens. As described above, however, by forming the exposure opening 252 and the heat exhaust hole 110 separately from each other, heated air inside the imaging unit 101 flows in the heat exhaust hole 110, so that inflow to the exposure opening 252 can be suppressed. As a result, toner particles and paper dusts can be suppressed from adhering to the dust-proof glass, so that a poor image such as a spotted image can be prevented from being produced.

According to the copying machine of the embodiment, the heat exhaust duct 111 is mounted on the unit frame 105 via the flexible coupling member. Even if there is unevenness on a unit frame mounting face of the heat exhaust duct 111 or on a heat exhaust duct mounting face of the unit frame 105, the unevenness on the mounting face can be absorbed by the flexible coupling member. As a result, the heat exhaust duct 111 can be mounted on the unit frame 105 without any gap. Therefore, toner particles and paper dusts entered from the heat exhaust hole 110 to the heat exhaust duct 111 together with heated air can be prevented from flowing near the dust-proof lens of the optical writing device from a gap between the heat exhaust duct 111 and the unit frame 105. Accordingly, toner particles and paper dusts are suppressed from adhering to the dust-proof glass, so that a poor image such as a spotted image can be prevented from being produced.

According to the copying machine of the embodiment, pressure inside the heat exhaust duct 111 is always kept lower than pressure around the exposure opening of the unit frame 105. Thus, a flow of air around the exposure opening forms a flow passing from the optical writing device 103 through the exposure opening 252 to move toward the imaging unit 101. Therefore, heated air inside the imaging unit 101 can be prevented from flowing in the exposure opening 252. As a result, toner particles and paper dusts can be suppressed from adhering to the dust-proof glass, so that a poor image such as a spotted image can be prevented from being produced.

According to the copying machine of the embodiment, the heat exhaust duct 111 is disposed at a position where it does not block each light beam emitted from the optical writing device 103 toward each image carrier. Therefore, it is unnecessary to form the heat exhaust duct 111 from transparent a material that does not block light beams. As a result, the heat exhaust duct 111 can be formed of an inexpensive metal member or a resin member.

According to the copying machine of the embodiment, the heat exhaust duct 111 is disposed between the optical writing device 103 and the unit frame 105 and the heat exhaust duct 111 is mounted on the unit frame 105, so that the heat exhaust duct can be disposed above the imaging unit 101 with a simple configuration.

Figure 20:
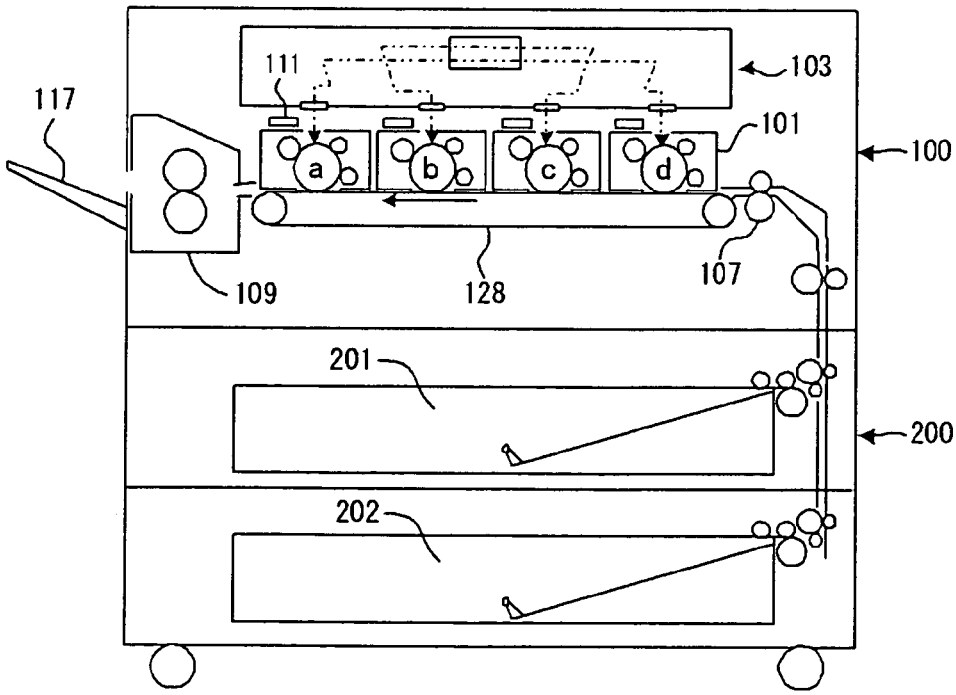
FIG. 20 is a schematic of a color printer adopting a direct transfer system.
Figure 21:
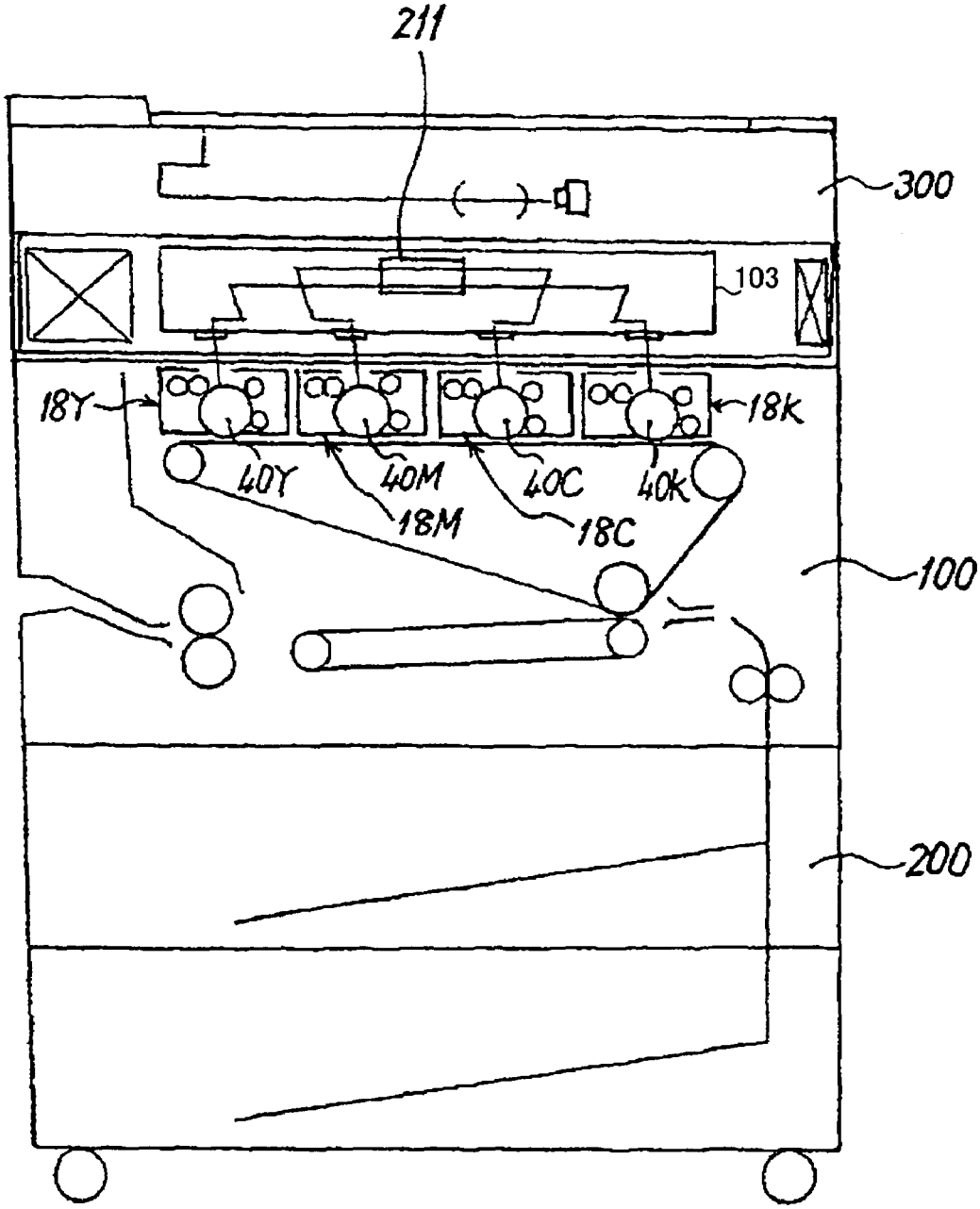
FIG. 21 is a schematic of a conventional image forming apparatus.

Although the tandem type copying machines according to the indirect transfer system have been described in the first to the third embodiments, the present invention is not limited to such a copying machine. The present invention is applicable to an image forming apparatus according to a direct transfer system. FIG. 20 is a schematic sectional configuration view of a tandem type color printer according to a direct transfer system. In the color printer shown in FIG. 20, respective color toner images are sequentially transferred directly from respective imaging units on a recording medium fed from the paper feeding unit 200 and conveyed by a transfer and conveyance belt 128 in a superimposing manner, thereby forming a full color image.

In such a color printer, one cooling mechanism is provided to each of the imaging units 101 to exhaust heats generated at the respective imaging units 101, particularly, heats occurring due to self-heating at the developing elements. As the cooling mechanism for the imaging unit, one of the configurations explained in the first to the third embodiments can be adopted.

In the first to the third embodiments, the examples in which the present invention is applied to the copying machine have been explained. However, the applicability of the present invention is not limited to the copying machine. The present invention can be applied to any apparatus, as far as the apparatus is an image forming apparatus that forms an image, such as a facsimile, a printer, and a multifunction product including a plurality of functions.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus, comprising:

a plurality of imaging units, each of which includes an image carrier and a developing device, the imaging units detachably arranged in a main unit of the image forming apparatus;

an optical writing device configured to scan respective light beams emitted from a light source toward respective image carriers, and to perform optical writing on the image carriers;

a heat exhaust duct provided for each of the imaging units and arranged between the optical writing device and each of the imaging units; and an exhaust fan arranged on a side opposite to a side from which the imaging units are attached or detached to and from the main unit, and configured to cause air heated at the imaging units to be exhausted outside the main unit via the heat exhaust ducts, wherein a cross-sectional shape of the heat exhaust duct in a direction normal to the image carrier is set such that a length thereof in a horizontal direction is larger than a length thereof in a vertical direction.

2. The image forming apparatus according to claim 1, further comprising a common duct arranged on the side opposite to the side from which the imaging units are attached and detached to and from the main unit, and configured to communicate with each of the heat exhaust ducts, wherein the exhaust fan is arranged in the common duct to cause the heated air to be exhausted outside the main unit via the heat exhaust ducts and the common duct.

3. The image forming apparatus according to claim 1, further comprising:

a frame member arranged just above the imaging units between the optical writing device and the imaging units to support the optical writing device; and a plurality of heat exhaust openings arranged in the frame member, each of the heat exhaust openings arranged at a position corresponding to each of the imaging units, to introduce heated air into respective heat exhaust ducts, wherein the heat exhaust openings are arranged in different sizes depending on position such that the closer a position of an imaging unit is to a heat source, the larger a size of a heat exhaust opening arranged at a position corresponding to the imaging unit is.

4. The image forming apparatus according to claim 3, wherein the heat source includes a fixing unit configured to fix an image.

5. The image forming apparatus according to claim 1, wherein each heat exhaust duct is configured to have a different capacity depending on position, such that the closer a position of an imaging unit is to a heat source, the larger a capacity of the heat exhaust duct provided for the imaging unit is.

6. The image forming apparatus according to claim 5, wherein the heat source includes a fixing unit configured to fix an image.

7. The image forming apparatus according to claim 3, wherein the heat exhaust openings are arranged in different sizes depending on position, such that the farther a position of the imaging unit is from the exhaust fan, the larger the size of the heat exhaust opening arranged at the position corresponding to the imaging unit is.

8. The image forming apparatus according to claim 3, wherein each heat exhaust duct is configured to have a different capacity such that the farther a position of the imaging unit is from the exhaust fan, the larger a capacity of the heat exhaust duct provided for the imaging unit is.

9. The image forming apparatus according to claim 3, further comprising a fitting unit configured to connect each heat exhaust duct and the frame member.

10. The image forming apparatus according to claim 9, wherein the fitting unit includes a receiving member, and a fitting member configured to fit in the receiving member, wherein the receiving member is arranged in any one of the heat exhaust ducts and the frame member, and the fitting member is arranged in the other one of the heat exhaust ducts and the frame member.

11. The image forming apparatus according to claim 10, wherein at least one of the receiving member and the fitting member is formed in a tapered shape.

12. The image forming apparatus according to claim 9, wherein the fitting unit is configured to connect each heat exhaust duct and the frame member as each heat exhaust duct is moved from a side of the main unit toward an opposite side to the side.

13. The image forming apparatus according to claim 3, further comprising an elastic member arranged between each heat exhaust duct and the frame member.

14. The image forming apparatus according to claim 2, further comprising a positioning member provided on each heat exhaust duct and configured to engage with the common duct.

15. The image forming apparatus according to claim 14, wherein the common duct is configured to press each heat exhaust duct from above.

16. The image forming apparatus according to claim 2, wherein the common duct is arranged such that the common duct does not overlap with the imaging units in a vertical direction.

17. The image forming apparatus according to claim 3, wherein the frame member includes an exposure opening through which the light beams from the optical writing device pass.

18. The image forming apparatus according to claim 17, wherein each heat exhaust duct is mounted on the frame member through foamed plastic.

19. The image forming apparatus according to claim 17, wherein atmospheric pressure inside each heat exhaust duct is lower than atmospheric pressure around the exposure opening.

20. The image forming apparatus according to claim 1, wherein each heat exhaust duct is arranged at a position where each heat exhaust duct does not block the light beams from the optical writing device.

* * * * *